US009879638B2

(12) United States Patent
Horiba et al.

(10) Patent No.: US 9,879,638 B2
(45) Date of Patent: Jan. 30, 2018

(54) EVAPORATED FUEL TREATMENT DEVICE

(71) Applicant: HONDA MOTOR CO., LTD., Minato-ku, Tokyo (JP)

(72) Inventors: Ayumu Horiba, Saitama (JP); Mahito Shikama, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 259 days.

(21) Appl. No.: 14/064,491

(22) Filed: Oct. 28, 2013

(65) Prior Publication Data

US 2014/0116401 A1 May 1, 2014

(30) Foreign Application Priority Data

Oct. 30, 2012 (JP) ..... 2012-239529
Oct. 30, 2012 (JP) ..... 2012-239531
Oct. 30, 2012 (JP) ..... 2012-239532

(51) Int. Cl.
*F02M 25/08* (2006.01)
*F02D 41/00* (2006.01)
*F02D 41/22* (2006.01)

(52) U.S. Cl.
CPC ..... *F02M 25/0809* (2013.01); *F02D 41/004* (2013.01); *F02D 2041/225* (2013.01)

(58) Field of Classification Search
USPC ..... 123/506, 516, 520, 568.22, 90.57, 518, 123/406.49, 406.68, 677, 193.5, 519
See application file for complete search history.

(56) References Cited

U.S. PATENT DOCUMENTS 5,542,397 A * 8/1996 Takahata ..... F02M 25/0809 123/520
5,954,034 A * 9/1999 Takagi ..... F02M 25/0809 123/198 D (Continued)

FOREIGN PATENT DOCUMENTS

JP H0642414 A 2/1994
JP 2004-156494 A 6/2004

(Continued)

OTHER PUBLICATIONS

Office Action dated Sep. 29, 2015 in the corresponding Japanese Patent Application No. JP2012-239529.

(Continued)

*Primary Examiner* — Hung Q Nguyen
*Assistant Examiner* — Brian P Monahon
(74) *Attorney, Agent, or Firm* — Carrier Blackman & Associates, P.C.; William D. Blackman; Joseph P. Carrier

(57) ABSTRACT

The objective of the present invention is to provide an evaporated fuel treatment device capable of performing a function diagnosis of a sealing valve with high accuracy even if an internal combustion engine is in operation. The evaporated fuel treatment device includes a sealing valve that blocks a fuel tank from the atmosphere, a canister, a canister internal pressure detection unit, a control part that performs an instruction for opening or closing the sealing valve and controls a purge, and a diagnostic part that performs a function diagnosis of an evaporated fuel sealing system including the fuel tank, the canister, and the sealing valve. The diagnostic part performs the function diagnosis of the sealing valve based on whether or not a canister internal pressure detected by the canister internal pressure sensor varies beyond a predetermined range.

16 Claims, 12 Drawing Sheets

(56) References Cited

U.S. PATENT DOCUMENTS 5,996,400 A * 12/1999 Nishioka ..... F02M 25/0809 73/40.5 R
7,448,367 B1 * 11/2008 Reddy ..... B60K 15/03519 123/519
7,762,126 B2 * 7/2010 Shibuya ..... F02D 41/0032 123/198 D
2002/0178791 A1 * 12/2002 Shigihama ..... F02M 25/0818 73/49.2
2004/0055386 A1 * 3/2004 Everingham ..... F02M 25/0809 73/716
2004/0089062 A1 * 5/2004 Matsubara ..... F02M 25/0818 73/114.41
2004/0089063 A1 * 5/2004 Matsubara ..... F02M 25/089 73/114.41
2004/0089064 A1 * 5/2004 Kidokoro ..... F02M 25/0809 73/114.41
2006/0016252 A1 * 1/2006 Iriyama ..... F02M 25/0809 73/114.39
2006/0059979 A1 * 3/2006 Matsubara ..... F02M 25/089 73/114.39
2006/0086343 A1 * 4/2006 Suzuki ..... F02M 25/0809 123/520
2007/0186915 A1 * 8/2007 Annoura ..... F02D 41/0042 123/698
2010/0126476 A1 * 5/2010 Hidano ..... F02M 25/089 123/519
2011/0203554 A1 * 8/2011 Horiba ..... F02D 41/0032 123/520
2012/0118159 A1 * 5/2012 Kitamura ..... F02M 37/0047 96/152
2012/0186333 A1 * 7/2012 Nishimura ..... F02M 25/0809 73/40.5 R

FOREIGN PATENT DOCUMENTS

JP 2010071199 A 4/2010
JP 2011025803 A 2/2011
JP 2012112306 A 6/2012
JP 2012172561 A 9/2012

OTHER PUBLICATIONS

Office Action dated Sep. 29, 2015 in the corresponding Japanese Patent Application No. JP2012-239532.
Office Action dated Oct. 6, 2015 in the corresponding Japanese Patent Application No. JP2012-239531.

* cited by examiner

EVAPORATED FUEL TREATMENT DEVICE

CROSS REFERENCE TO RELATED APPLICATIONS

This application claims the foreign priority benefit under Title 35, United States Code, 119 (a)-(d) of Japanese Patent Application No. 2012-239529, No. 2012-239531, No. 2012-239532 filed on Oct. 30, 2012 in the Japan Patent Office, the disclosure of which is herein incorporated by reference in its entirety.

TECHNICAL FIELD

The present invention relates to an evaporated fuel treatment device for treating an evaporated fuel.

BACKGROUND ART

In a vehicle including an internal combustion engine, for example, when a fuel tank is refueled, since a volume occupied by a liquid fuel in an internal space of the fuel tank increases, a volume occupied by a gas phase region in the internal space decreases relatively, and a pressure in the gas phase region (hereinafter, referred to as a "tank internal pressure") becomes higher than the atmospheric pressure. As a result, the evaporated fuel in the gas phase region accumulated in the fuel tank is going to get out to the atmosphere. If the evaporated fuel is released into the atmosphere, the atmosphere will be polluted.

Therefore, in order to prevent the atmospheric pollution caused by the release of the evaporated fuel into the atmosphere, a conventional evaporated fuel treatment device is provided with a canister having an adsorbent for adsorbing temporarily the evaporated fuel on a communication passage between the fuel tank and the atmosphere, so that the tank internal pressure can be suppressed low by adsorbing the evaporated fuel to the adsorbent of the canister.

Patent Document 1, for example, discloses an evaporated fuel treatment device including a fuel tank with a sealed structure by providing a closing valve (hereinafter, referred to as a sealing valve) for controlling a communication state between the fuel tank and the canister on the communication passage of the evaporated fuel between the fuel tank and the canister. In the evaporated fuel treatment technology according to Patent Document 1, during stop of the internal combustion engine, the sealing valve is closed and the canister is open to the atmosphere. When the internal combustion engine is stopped and there is a pressure difference exceeding an open valve determination value between the tank internal pressure and the atmospheric pressure, the sealing valve is opened and a variation of the tank internal pressure which is generated before and after opening the sealing valve is detected. If the detected variation of the tank internal pressure is less than a predetermined value, the sealing valve is determined to be in a closing failure.

The evaporated fuel treatment technology according to Patent Document 1 makes it possible to efficiently detect the closing failure of the sealing valve without causing a negative pressurization of the tank internal pressure in the normal control.

CITATION LIST

Patent Literature

{Patent Document 1}
Japanese Patent Application Publication No. 2004-156494

SUMMARY OF INVENTION

Technical Problem

The evaporated fuel treatment technology according to Patent Document 1 diagnoses, when an open valve instruction is issued to the sealing valve during purging the evaporated fuel while a vehicle is traveling (internal combustion engine is in operation), whether or not the sealing valve is in the closing failure based on whether or not a significant decrease in the tank internal pressure is caused after the open valve instruction (refer to paragraphs [0136] to [0140]).

However, in the technology according to Patent Document 1 that performs a function diagnosis of the sealing valve during purging the evaporated fuel while the vehicle is traveling, if a variation (for example, rapid acceleration) occurs in an operation state of the internal combustion engine, the variation influences an internal pressure of an evaporated fuel sealing system including the fuel tank, the canister, and the sealing valve, and a variation trend of the tank internal pressure is deviated from an original one. Therefore, it is difficult to perform the function diagnosis of the sealing valve with high accuracy.

The present invention has been made to solve the above problem, and the objective of the present invention is to provide an evaporated fuel treatment device capable of performing the function diagnosis of the sealing valve even if the internal combustion engine is in operation.

Solution to Problem

To achieve the above objective, a first aspect of the present invention is characterized in that an evaporated fuel treatment device includes a sealing valve that is provided on a communication passage between an atmosphere and a fuel tank mounted on a vehicle having an internal combustion engine, and blocks the fuel tank from the atmosphere, a canister that is provided between the atmosphere and the sealing valve on the communication passage, and recovers evaporated fuel discharged through the communication passage from the fuel tank, a canister internal pressure detection unit that is provided on the canister side relative to the sealing valve on the communication passage, and detects a canister internal pressure in the canister, a control part that performs an instruction for opening or closing the sealing valve, and controls a purge, and a diagnostic part that performs a function diagnosis of an evaporated fuel sealing system including the fuel tank, canister, and the sealing valve.

In the first aspect of the present invention, the diagnostic part performs the function diagnosis of the sealing valve based on whether or not the canister internal pressure detected by the canister internal pressure detection unit varies beyond a predetermined range, in a state where the sealing valve is open according to the instruction by the control part, when the internal combustion engine is in operation and the purge by the control part is not performed.

The fuel tank according to the present invention employs in principle a sealing structure in which the sealing valve is closed. In the internal space on the fuel tank side of the evaporated fuel sealing system, the evaporated fuel is generated by the influence of environmental temperature or residual heat of the internal combustion engine. Therefore, the tank internal pressure is usually maintained at a positive pressure relative to the atmospheric pressure. On the other hand, the pressure in the internal space on the canister side of the evaporated fuel sealing system is the atmospheric pressure.

In these circumstances, when the sealing valve kept in a closed state is opened properly, the tank internal pressure on the fuel tank side of the evaporated fuel sealing system decreased, while the canister internal pressure on the canister side of the evaporated fuel sealing system increases. This is because the internal pressure deviation between the tank internal pressure and the canister internal pressure is immediately balanced by opening properly the sealing valve kept in the closed state.

As described above, by utilizing the characteristics that the internal pressure deviation between the tank internal pressure and the canister internal pressure is immediately balanced by opening properly the sealing valve kept in the closed state, it is possible to perform the function diagnosis of whether or not the sealing valve kept in the closed state is opened properly based on whether or not the canister internal pressure varies beyond a predetermined range by a trigger of opening the sealing valve.

The function diagnosis of whether or not the sealing valve is opened properly is performed when the internal combustion engine is in operation and the purge by the control part is not performed. If the function diagnosis of the sealing valve is performed while the purge is performed, it becomes a state in which the evaporated fuel sealing system is communicated with the internal combustion engine side by opening the sealing valve. In this state, if a variation (for example, rapid acceleration) occurs in an operation state of the internal combustion engine, the variation influences the internal pressure of the evaporated fuel sealing system, and a variation trend of the tank internal pressure is deviated from an original one. Therefore, it is difficult to perform the function diagnosis of the sealing valve with high accuracy.

According to the first aspect of the present invention, the function diagnosis of the sealing valve is performed based on whether or not the canister internal pressure varies beyond the predetermined range, in the state where the sealing valve is open, when the internal combustion engine is in operation and the purge is not performed. Therefore, it is possible to perform the function diagnosis of the sealing valve with high accuracy even if the internal combustion engine is in operation.

Further, a second aspect of the present invention is the evaporated fuel treatment device according to the first aspect of the present invention, wherein the diagnostic part makes a diagnosis that the sealing valve functions properly if the canister internal pressure detected by the canister internal pressure detection unit varies beyond a predetermined range.

According to the second aspect of the present invention, it is possible to perform a diagnosis that the sealing valve functions properly with high accuracy, in addition to an effect of the first aspect of the present invention.

Further, a third aspect of the present invention is the evaporated fuel treatment device according to the first aspect of the present invention, wherein the instruction for opening the sealing valve by the control part is performed immediately after the purge beyond a predetermined amount is performed.

In the third aspect of the present invention, when the purge beyond the predetermined amount is performed, the evaporated fuel generated until shortly before the purge in the fuel tank side among the evaporated fuel sealing system, flows out to the side of the internal combustion engine via the canister and the like. Immediately after the evaporated fuel in the fuel tank side among the evaporated fuel sealing system flows out in this way, the control part is operative to perform the instruction for opening the sealing valve.

According to the third aspect of the present invention, it is possible to expect an effect of performing accurately a combustion control of the internal combustion engine, in addition to the effect of the first aspect of the present invention, because it is possible to suppress a situation in which the evaporated fuel in the fuel tank side among the evaporated fuel sealing system flows out to the internal combustion engine side.

Further, a fourth aspect of the present invention is the evaporated fuel treatment device according to the first aspect of the present invention, further including a tank internal pressure detection unit that detects the tank internal pressure in the fuel tank, wherein the instruction for opening the sealing valve by the control part is performed immediately after the purge beyond a predetermined amount is performed, if the tank internal pressure detected by the tank internal pressure detection unit is below a predetermined value.

A difference between the third aspect of the present invention and the fourth aspect of the present invention is that it is added as a condition for performing the instruction for opening the sealing valve by the control part that the tank internal pressure detected by the tank internal pressure detection unit is below the predetermined value. A fact that the tank internal pressure detected by the tank internal pressure detection unit is below the predetermined value means that the evaporated fuel in the fuel tank side among the evaporated fuel sealing system decreases to an extent below an amount corresponding to the predetermined value.

According to the fourth aspect of the present invention, it is possible to expect an effect of performing more accurately the combustion control of the internal combustion engine, in addition to the effect of the first aspect of the present invention.

Further, a fifth aspect of the present invention is the evaporated fuel treatment device according to the first aspect of the present invention, further including a tank internal pressure detection unit that detects the tank internal pressure in the fuel tank, wherein the instruction for opening the sealing valve by the control part is performed immediately after the purge beyond a predetermined amount is performed, if the tank internal pressure detected by the tank internal pressure detection unit is beyond a predetermined value.

A difference between the third aspect of the present invention and the fifth aspect of the present invention is that it is added as the condition for performing the instruction for opening the sealing valve by the control part that the tank internal pressure detected by the tank internal pressure detection unit is beyond the predetermined value. A fact that the tank internal pressure detected by the tank internal pressure detection unit is beyond the predetermined value means that it is easy to obtain a temporal variation of the canister internal pressure associated with opening the sealing valve, because a pressure difference between the tank internal pressure and the canister internal pressure should be large.

According to the fifth aspect of the present invention, it is possible to expect an effect of easily obtaining the temporal variation of the canister internal pressure associated with opening the sealing valve, in addition to the effect of the first aspect of the present invention.

On the other hand, a sixth aspect of the present invention is the evaporated fuel treatment device according to the first aspect of the present invention, further including a switching valve that is provided between the atmosphere and the canister on the communication passage, and opens or blocks the canister to the atmosphere.

In the sixth aspect of the present invention, the tank internal pressure detection unit for detecting the tank internal pressure in the fuel tank is provided between the sealing valve and the fuel tank on the communication passage. Therefore, under normal operating conditions, the tank internal pressure detection unit mainly plays a role for detecting the tank internal pressure in the fuel tank. However, if the tank internal pressure detection unit fails and outputs an abnormal value containing an error, the leak diagnosis of the evaporated fuel sealing system is performed by using the abnormal value. As a result, there is a possibility of causing a situation impairing accuracy in the leak diagnosis.

Therefore, in the sixth aspect of the present invention, the control part performs an instruction for opening the sealing valve, and performs an instruction for closing the switching valve during stop of the internal combustion engine, and the canister internal pressure detection unit is at least used for detection of a tank internal pressure in the fuel tank while the sealing valve is open and the switching valve is closed according to the instruction by the control part.

With this configuration, for example, by cross-checking a detected value of the tank internal pressure by the tank internal pressure detection unit with a detected value of the tank internal pressure by the canister internal pressure detection unit, it is possible to verify at least one of a validity of the detected value of the tank internal pressure by the tank internal pressure detection unit and a validity of the detected value of the tank internal pressure by the canister internal pressure detection unit.

According to the sixth aspect of the present invention, it is possible to perform the leak diagnosis with high accuracy even if the tank internal pressure detection unit outputs the abnormal value containing the error.

Further, a seventh aspect of the present invention is the evaporated fuel treatment device according to the sixth aspect of the present invention, wherein the diagnostic part has a function of performing a leak diagnosis of the evaporated fuel sealing system, and makes a diagnosis that there is no leak at least on the fuel tank side in the evaporated fuel sealing system if the canister internal pressure detection unit detects that the tank internal pressure varies beyond a predetermined range while the sealing valve is open and the switching valve is closed.

According to the seventh aspect of the present invention, similarly to the sixth aspect of the present invention, it is possible to perform the leak diagnosis with high accuracy even if the tank internal pressure detection unit outputs the abnormal value containing the error.

Further, an eighth aspect of the present invention is the evaporated fuel treatment device according to the seventh aspect of the present invention, wherein a length of period when the sealing valve is open and the switching valve is closed, is set considering that a variation of the tank internal pressure is detectable.

According to the eighth aspect of the present invention, it is possible to appropriately set a length of period when the sealing valve is open and the switching valve is closed, in addition to operational effects described in the seventh aspect of the present invention.

Further, a ninth aspect of the present invention is the evaporated fuel treatment device according to the seventh aspect of the present invention, wherein the diagnostic part has further a function of diagnosing an internal pressure detection function by the canister internal pressure detection unit, and diagnoses the internal pressure detection function by the canister internal pressure detection unit with reference to a detected value of the atmospheric pressure by another pressure detection unit capable of detecting the atmospheric pressure.

According to the ninth aspect of the present invention, it is possible to recognize an abnormality of the canister internal pressure detection unit accurately and quickly, because the internal pressure detection function by the canister internal pressure detection unit is diagnosed with reference to the detected value of the atmospheric pressure by another pressure detection unit, in addition to operational effects described in the seventh aspect of the present invention.

On the other hand, a tenth aspect of the present invention is the evaporated fuel treatment device according to the first aspect of the present invention, further including a tank internal pressure detection unit that is provided on the fuel tank side relative to the sealing valve on the communication passage, and detects a tank internal pressure in the fuel tank, wherein the diagnostic part has a function of performing a leak diagnosis of the evaporated fuel sealing system, and when the diagnostic part performs the leak diagnosis, in a state where the sealing valve is closed according to the instruction by the control part, the diagnostic part makes a diagnosis that at least the tank internal pressure detection unit functions properly if a deviation of a tank internal pressure detected by the tank internal pressure detection unit at around the time of stopping the internal combustion engine from the tank internal pressure detected by the tank internal pressure detection unit at the time after a predetermined time elapses from the stopping of the internal combustion engine exceeds a predetermined deviation threshold value.

In general, when the elapsed time after the internal combustion engine is stopped exceeds the predetermined time, the tank internal pressure is out of a vicinity of the atmospheric pressure in many cases. In the fuel tank of the vehicle during parking, the evaporated fuel is generated by the influence of the environmental temperature and the residual heat of the internal combustion engine. Further, the fuel tank according to the present invention adopts a sealed structure which closes the sealing valve during stop of the internal combustion engine.

However, for example, if the tank internal pressure detection unit does not operate properly due to a sticking failure, the tank internal pressure, which is a detected value by the tank internal pressure detection unit, shows a tendency of not varying before and after the predetermined time elapses from the stopping of the internal combustion engine. Therefore, it is possible to perform a diagnosis whether or not the tank internal pressure detection unit operates properly based on whether or not the tank internal pressure varies before and after the predetermined time elapses from the stopping of the internal combustion engine.

Meanwhile, the diagnostic part makes a diagnosis that at least the canister internal pressure detection unit functions properly if a variation range of the canister internal pressure detected by the canister internal pressure detection unit exceeds a predetermined value when the sealing valve is switched to an open state from a closed state according to the instruction by the control part during stop of the internal combustion engine.

When the sealing valve is switched to the open state from the closed state, and then switched to the closed state after a predetermined open period, the tank internal pressure detected by the tank internal pressure detection unit decreases by the trigger of opening the sealing valve, while the canister internal pressure detected by the canister internal pressure detection unit increases. This is because, on the assumption that the tank internal pressure is higher than the canister internal pressure (atmospheric pressure), the internal pressure deviation between the tank internal pressure and the canister internal pressure is immediately balanced by the sealing valve being switched to the open state from the closed state.

As described above, the internal pressure deviation between the tank internal pressure and the canister internal pressure is immediately balanced, when the sealing valve maintained in the closed state is properly switched to the open state. Therefore, by utilizing such characteristics, it is possible to perform a diagnosis of whether or not the sealing valve is properly switched to the open state from the closed state based on whether or not the canister internal pressure increases beyond a predetermined threshold value by the trigger of opening the sealing valve.

According to the tenth aspect of the present invention, it is possible to diagnose whether or not the tank internal pressure detection unit and the sealing valve operate properly when the leak diagnosis is performed.

Further, an eleventh aspect of the present invention is the evaporated fuel treatment device according to the tenth aspect of the present invention, wherein when the diagnostic part performs the leak diagnosis, in a state where the sealing valve is closed according to the instruction by the control part, the diagnostic part makes the diagnosis that the tank internal pressure detection unit functions properly if the deviation of the tank internal pressure detected by the tank internal pressure detection unit at around the time of stopping the internal combustion engine from the tank internal pressure detected by the tank internal pressure detection unit at the time after the predetermined time elapses from the stopping of the internal combustion engine exceeds the predetermined deviation threshold value, while the diagnostic part makes a diagnosis that the sealing valve functions properly if the variation range of the canister internal pressure detected by the canister internal pressure detection unit exceeds the predetermined value when the sealing valve is switched to the open state from the closed state according to the instruction by the control part during stop of the internal combustion engine.

According to the eleventh aspect of the present invention, similarly to the tenth aspect of the present invention, it is possible to diagnose whether or not the tank internal pressure detection unit and the sealing valve operate properly when the leak diagnosis is performed.

Further, a twelfth aspect of the present invention is the evaporated fuel treatment device according to the tenth aspect of the present invention, wherein the diagnostic part performs at least a diagnosis of the canister internal pressure detection unit after a diagnosis of the tank internal pressure detection unit.

According to the twelfth aspect of the present invention, it is possible to perform at least a diagnosis of the canister internal pressure detection unit after a diagnosis of the tank internal pressure detection unit, before the sealing valve is switched to the open state from the closed state (in a state where the sealing valve is closed).

Further, a thirteenth aspect of the present invention is the evaporated fuel treatment device according to the tenth aspect of the present invention, wherein a length of period when the sealing valve is in an open state, is set considering that a variation of the canister internal pressure is detectable.

According to the thirteenth aspect of the present invention, it is possible to set appropriately the length of period when the sealing valve is in the open state, in addition to operational effects of the tenth aspect of the present invention.

Advantageous Effects of Invention

By using an evaporated fuel treatment device according to the present invention, it is possible to perform the function diagnosis of the sealing valve with high accuracy even if the internal combustion engine is in operation.

BRIEF DESCRIPTION OF DRAWINGS

FIG. 4A is a time chart describing operations of each part belonging to the evaporated fuel treatment device until a predetermined time elapses after an ignition switch is switched to OFF from ON.

DESCRIPTION OF EMBODIMENTS

Figure 1A:
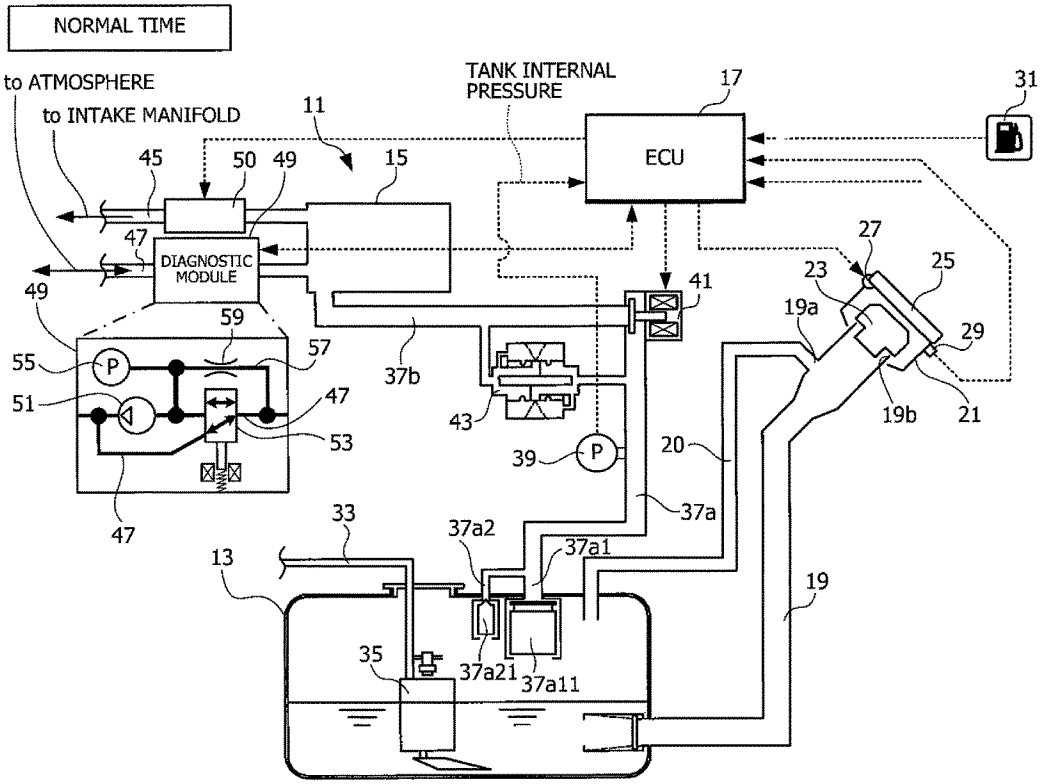
FIG. 1A is an overall configuration diagram showing an overview of an evaporated fuel treatment device (normal time) according to an embodiment of the present invention.

Hereinafter, an evaporated fuel treatment device according to the present invention will be described in detail with reference to drawings.

[Overview of an Evaporated Fuel Treatment Device 11 According to an Embodiment of the Present Invention]

First, an overview of the evaporated fuel treatment device 11 according to the embodiment of the present invention will be described with reference to the drawings, with an example applied to a hybrid vehicle including an electric motor and an internal combustion engine (both are not shown) as driving forces. Note that, in the following drawings, the same members or corresponding members are denoted by the same reference numerals. Further, the size or shape of the members may be illustrated schematically by deformation or exaggeration for convenience of description.

Figure 1B:
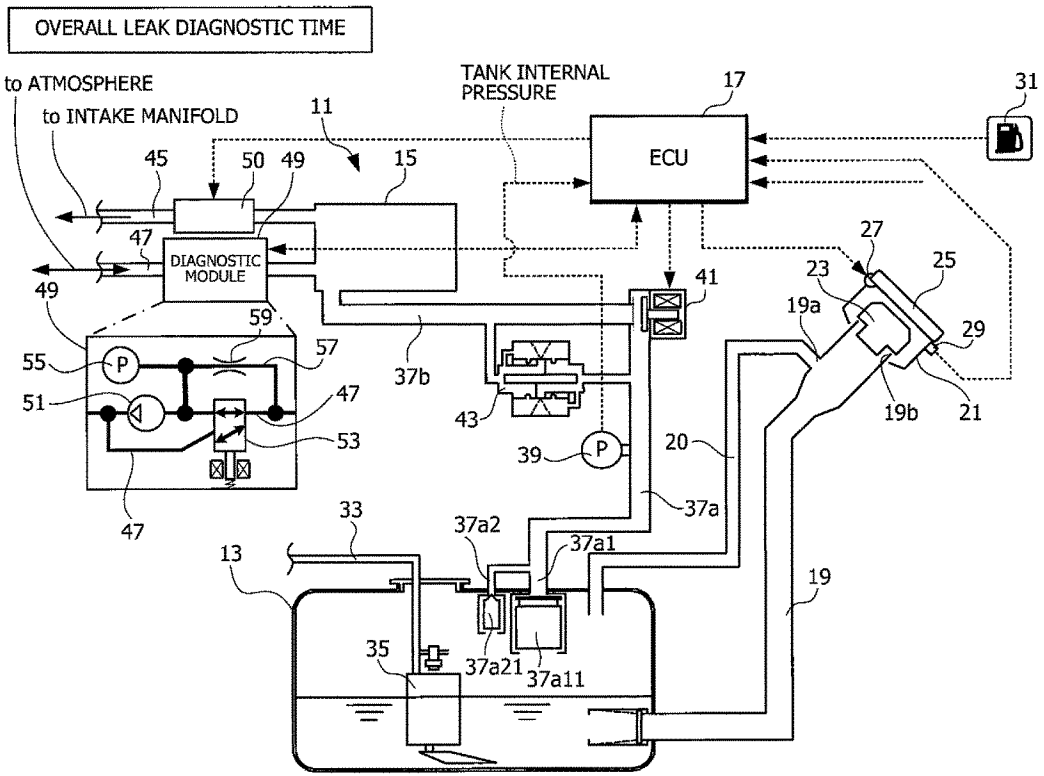
FIG. 1B is an overall configuration diagram showing the overview of the evaporated fuel treatment device (at a time of diagnosis of a whole evaporated fuel sealing system) according to the embodiment of the present invention.
Figure 1C:
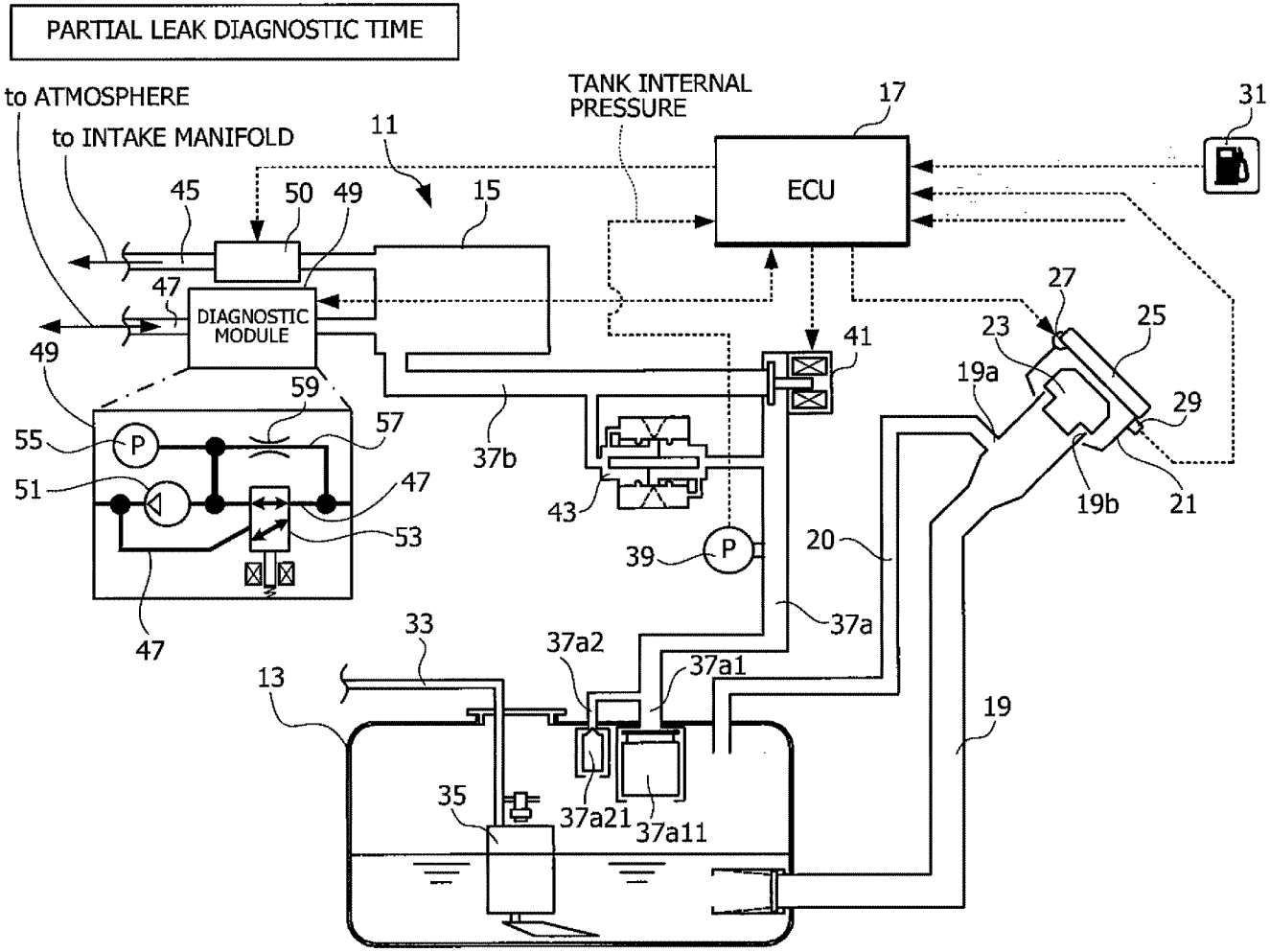
FIG. 1C is an overall configuration diagram showing the overview of the evaporated fuel treatment device (at a time of diagnosis of a canister side of an evaporated fuel sealing system) according to the embodiment of the present invention.
Figure 2:
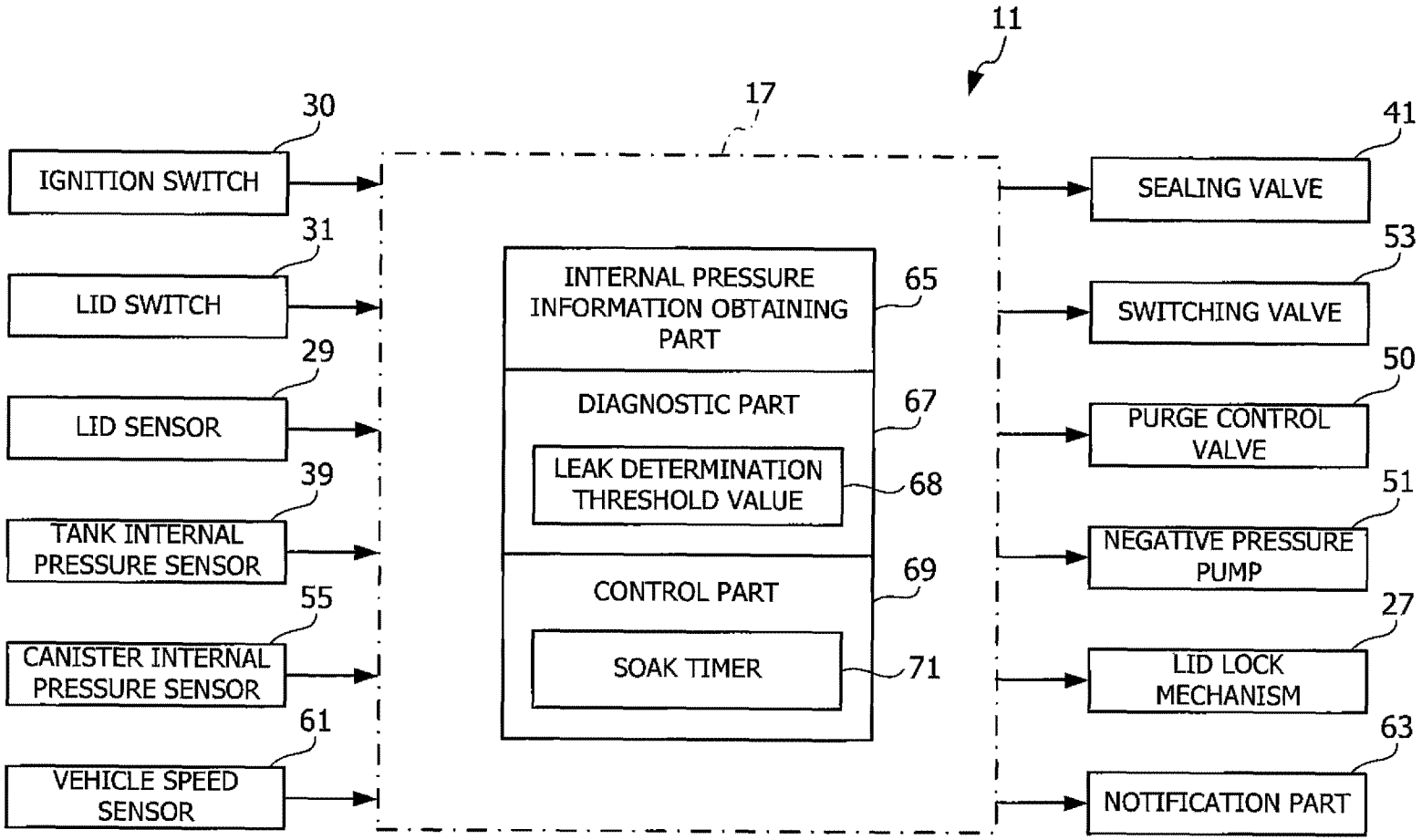
FIG. 2 is a functional block diagram showing the overview of the evaporated fuel treatment device according to the embodiment of the present invention.

FIGS. 1A to 1C are overall configuration diagrams showing overviews of the evaporated fuel treatment device 11 according to the embodiment of the present invention. Among them, FIG. 1A, FIG. 1B, and FIG. 1C respectively show the evaporated fuel treatment device 11 at normal time, the evaporated fuel treatment device 11 at a time of diagnosis of a whole evaporated fuel sealing system, and the evaporated fuel treatment device 11 at a time of diagnosis of a canister side of the evaporated fuel sealing system. FIG. 2 is a functional block diagram showing the overview of the evaporated fuel treatment device 11.

The evaporated fuel treatment device 11 has a function of treating the evaporated fuel. The evaporated fuel treatment device 11 serving to treat the evaporated fuel includes, as shown in FIGS. 1A to 1C, a canister 15 having a function of adsorbing the evaporated fuel generated in a fuel tank 13, and an ECU (Electronic Control Unit) 17 performing an overall control of the evaporated fuel treatment device 11, and the like. In the following description, the common parts of FIGS. 1A to 1C will be described with reference to FIG. 1A, the different parts from FIG. 1A will be described with reference to FIGS. 1B, 1C appropriately.

The fuel tank 13 has a function of storing liquid fuel such as gasoline. The fuel tank 13 is provided with a fuel inlet pipe 19. The fuel inlet pipe 19 is provided with a circulation pipe 20 to be communicatively connected between an upstream portion 19*a* thereof and the fuel tank 13. On the opposite side of the fuel tank 13, the fuel inlet pipe 19 is provided with a fuel supply port 19*b* through which a fuel gun nozzle (not shown) is inserted. The fuel supply port 19*b* is accommodated in a fuel inlet box 21 provided in a concave shape on a rear fender of an unillustrated vehicle body. The fuel supply port 19*b* is attached with a screw-type filler cap 23.

The fuel inlet box 21 is attached with a fuel lid 25 which covers the filler cap 23 and can be freely open or closed. The fuel lid 25 includes a lid lock mechanism 27 for restricting opening of the fuel lid 25. In order to remotely release the locking of the lid lock mechanism 27 at refueling time, a lid switch 31 operated by an operator is provided in a vehicle compartment.

The fuel lid 25 is provided with a lid sensor 29 for detecting the open or closed state relating to the opening or closing of the fuel lid 25. Information relating to the opening or closing of the fuel lid 25 detected by the lid sensor 29 is sent to the ECU 17.

The fuel lid 25 is locked by the lid lock mechanism 27 to be kept in the closed state at normal time except refueling time. On the other hand, at refueling time, the ECU 17 releases the locking of the lid lock mechanism 27, if the lid switch 31 is operated and a predetermined condition to be described later is satisfied. Thus, the fuel lid 25 is opened. The operator can remove the filler cap 23, which is accessible by the opening of the fuel lid 25, from the fuel supply port 19*b*, and refuel the fuel tank 13 by inserting the fuel gun nozzle (not shown) into the fuel supply port 19*b*.

The fuel tank 13 is provided with a fuel pump module 35 which pumps up the fuel stored in the fuel tank 13 and sends out the fuel to unillustrated injectors through a fuel supply passage 33. Further, the fuel tank 13 is provided with an evaporated fuel discharging passage (corresponds to a "communication passage between the fuel tank and the atmosphere" of the present invention) 37 to be communicatively connected between the fuel tank 13 and the canister 15. The evaporated fuel discharging passage 37 has a function as a flow passage of the evaporated fuel.

The evaporated fuel discharging passage 37 has the fuel tank 13 side ends bifurcated into two. One side passage 37*a*1 of the evaporated fuel discharging passage 37 bifurcated into two is provided with a float valve 37*a*11. The other side passage 37*a*2 of the evaporated fuel discharging passage 37 is provided with a cut valve 37*a*21.

The float valve 37*a*11 is operative to be closed when a tank internal pressure Ptank, which is a pressure of a gas phase in the fuel tank 13, increases due to a raise of a liquid surface of the fuel accompanying to refueling. Specifically, the float valve 37*a*11 prevents the fuel from entering the evaporated fuel discharging passage 37 from the fuel tank 13 by the float valve 37*a*11 being closed when the fuel tank is filled with fuel.

On the other hand, the cut valve 37*a*21 is operative to be closed when the vehicle is inclined beyond a predetermined angle. Specifically, the cut valve 37*a*21 is open when the fuel tank is filled with fuel, however, it prevents the fuel from entering the evaporated fuel discharging passage 37 from the fuel tank 13 by the cut valve 37*a*21 being closed when the vehicle is inclined beyond the predetermined angle.

The evaporated fuel discharging passage 37 is provided with a tank internal pressure sensor 39, a sealing valve 41, and a high pressure two-way valve 43. In the following description, the fuel tank 13 side relative to the sealing valve 41 of the evaporated fuel discharging passage 37 may be referred to as a first evaporated fuel discharging passage 37*a*, and the canister 15 side relative to the sealing valve 41 of the evaporated fuel discharging passage 37 may be referred to as a second evaporated fuel discharging passage 37*b*. When collectively referred to the first and second evaporated fuel discharging passages 37*a*, 37*b*, it is referred to as the "evaporated fuel discharging passage 37".

The tank internal pressure sensor 39 is provided on the first evaporated fuel discharging passage 37*a*. The tank internal pressure sensor 39 corresponds to a "tank internal pressure detection unit" of the present invention. The tank internal pressure sensor 39 has a function of detecting the tank internal pressure Ptank which is the pressure in the gas phase in the fuel tank 13. However, it may be adopted that the tank internal pressure sensor 39 is configured to be provided directly in the fuel tank 13. It is possible to use a piezoelectric element as the pressure detection unit of the tank internal pressure sensor 39. Information relating to the tank internal pressure Ptank detected by the tank internal pressure sensor 39 is sent to the ECU 17.

The sealing valve 41 has a function of blocking the internal space of the fuel tank 13 from the atmosphere. Specifically, the sealing valve 41 is an electromagnetic valve of normally closed type which operates according to an opening/closing control signal sent from the ECU 17. As described in detail later, the sealing valve 41 is operative to seal the internal space in the fuel tank 13 from the atmosphere or allow the internal space in the fuel tank 13 to communicate with the atmosphere according to the opening/closing control signal.

The high pressure two-way valve 43 has a function of controlling the flow direction of the evaporated fuel based on a pressure difference between a pressure of the fuel tank 13 side and a pressure of the canister 15 side. Specifically, the high pressure two-way valve 43 is disposed in parallel with the sealing valve 41 on the evaporated fuel discharging passage 37, and is a mechanical valve in which a positive pressure valve and a negative pressure valve of diaphragm type are combined.

The positive pressure valve in the high pressure two-way valve 43 is operative to open when the pressure of the fuel tank 13 side becomes higher than the pressure of the canister 15 side by a predetermined pressure. By this opening operation, the evaporated fuel having a high pressure in the fuel tank 13 is sent to the canister 15 side via the positive pressure valve in the high pressure two-way valve 43.

On the other hand, the negative pressure valve in the high pressure two-way valve 43 is operative to open when the pressure of the fuel tank 13 side becomes lower than the pressure of the canister 15 side by a predetermined pressure. By this opening operation, the evaporated fuel stored in the canister 15 is sent back to the fuel tank 13 side via the negative pressure valve in the high pressure two-way valve 43.

The canister 15 provided on the second evaporated fuel discharging passage 37*b* incorporates an adsorbent (not shown) made of activated carbon for adsorbing the evaporated fuel. The adsorbent in the canister 15 adsorbs the evaporate fuel sent from the fuel tank 13 side through the evaporated fuel discharging passage 37. The canister 15 is communicatively connected with a purge passage 45 and an atmosphere introduction passage 47, in addition to the second evaporated fuel discharging passage 37*b*. The canister 15 is operative to perform a purge process to send the air introduced through the atmosphere introduction passage 47 together with the evaporated fuel adsorbed by the adsorbent in the canister 15 to an intake manifold through the purge passage 45.

The purge passage 45 is provided with a purge control valve 50. The purge control valve 50 has a function of controlling a purge flow rate of the evaporated fuel. Specifically, the purge control valve 50 is an electromagnetic valve of normally closed type which operates according to a purge control signal sent from the ECU 17. As described in detail later, the purge control valve 50 is operative to block the internal space of the canister 15 from the internal combustion engine or allow the internal space of the canister 15 to communicate with the internal combustion engine, according to the purge control signal.

The purge passage 45 is communicatively connected to an unillustrated intake manifold at the opposite side of the canister 15. Meanwhile, the atmosphere introduction passage 47 is communicatively connected to the atmosphere at the opposite side of the canister 15. The atmosphere introduction passage 47 is provided with a diagnostic module 49.

In detail, as shown in FIGS. 1A to 1C, the diagnostic module 49 includes the atmosphere introduction passage 47, and a bypass passage 57 provided in parallel with the atmosphere introduction passage 47. The atmosphere introduction passage 47 is provided with a switching valve 53. The switching valve 53 has a function of opening or blocking the canister 15 to the atmosphere. Specifically, the switching valve 53 is an electromagnetic valve which operates according to a switching signal sent from the ECU 17. The switching valve 53 allows the canister 15 to communicate with the atmosphere in nonenergized OFF state (see FIG. 1A), while it blocks the canister 15 from the atmosphere in an ON state in which the switching signal is sent from the ECU 17 (see FIGS. 1B and 1C).

Meanwhile, the bypass passage 57 is provided with a negative pressure pump 51, a canister internal pressure sensor 55, and a reference orifice 59. The negative pressure pump 51 has a function of making negative the internal pressure of the evaporated fuel sealing system to be described later by releasing the gases existing in the internal space of the evaporated fuel sealing system into the atmosphere.

Here, the evaporated fuel sealing system is a closed system including the fuel tank 13, the evaporated fuel discharging passage 37, the sealing valve 41, the canister 15, the atmosphere introduction passage 47, and the diagnostic module 49. The evaporated fuel sealing system is configured to include the fuel tank side and the canister side. The fuel tank side is a closed space from the fuel tank 13 to the sealing valve 41 through the first evaporated fuel discharging passage 37*a*. The canister side is a closed space from the sealing valve 41 to the diagnostic module 49 through the second evaporated fuel discharging passage 37*b*, the canister 15, and the atmosphere introduction passage 47.

The canister internal pressure sensor 55 corresponds to a "canister internal pressure detection unit" of the present invention. The canister internal pressure sensor 55 has a function of detecting the canister internal pressure of the canister 15. However, the canister internal pressure sensor 55 is operative to detect the atmospheric pressure when the switching valve 53 is switched to an atmosphere communication side which allows the canister 15 to communicate with the atmosphere (see FIG. 1A). Meanwhile, the canister internal pressure sensor 55 is operative to detect a variation of the tank internal pressure in the fuel tank 13, when the fuel tank 13 communicates with the canister 15 through the evaporated fuel discharging passage 37 by the opening of the sealing valve 41, and the switching valve 53 is switched to an atmosphere block side where the canister 15 is blocked from the atmosphere (see FIG. 1B).

The reference orifice 59 is, as described later, used when setting a leak determination threshold value for determining whether or not a leak occurs in a case of performing a leak diagnosis of the evaporated fuel sealing system.

The diagnostic module 49 is, as described later, used when performing the leak diagnosis of the evaporated fuel sealing system and a function diagnosis of the sealing valve 41 and the switching valve 53.

The ECU 17 corresponds to a "control part" of the present invention. The ECU 17 is, as shown in FIG. 2, connected with an ignition switch 30, the lid switch 31, the lid sensor 29, the tank internal pressure sensor 39, the canister internal pressure sensor 55, and a vehicle speed sensor 61, as an input system. The vehicle speed sensor 61 has a function of detecting a speed of the vehicle (not shown). Information relating to the speed of the vehicle detected by the vehicle speed sensor 61 is sent to the ECU 17.

Further, the ECU 17 is, as shown in FIG. 2, connected with the sealing valve 41, the switching valve 53, the purge control valve 50, the negative pressure pump 51, the lid lock mechanism 27, and a notification part 63, as an output system. The notification part 63 has a function of notifying information relating to the leak diagnosis of the evaporated fuel sealing system and the function diagnosis of the sealing valve 41 and the switching valve 53. Specifically, the notification part 63 can suitably use an audio output unit such as a speaker and a display unit (not shown) such as a liquid crystal display provided in the vehicle compartment.

As shown in FIG. 2, the ECU 17 is configured to include an internal pressure information obtaining part 65, a diagnostic part 67, and a control part 69.

The ECU 17 is configured with a microcomputer including CPU (Central Processing Unit), ROM (Read Only Memory), RAM (Random Access Memory), and the like. The microcomputer is operative to read and execute programs and data stored in the ROM, and perform execution control according to various functions, which the ECU 17 has, including an internal pressure information obtaining function, a diagnostic function, and an integrated control function of the evaporated fuel treatment device 11 as a whole.

The internal pressure information obtaining part 65 has a function of obtaining internal pressure information according to the tank internal pressure or the canister internal pressure detected by the tank internal pressure sensor 39 or the canister internal pressure sensor 55.

The diagnostic part 67 has a function of performing the leak diagnosis of the evaporated fuel sealing system, and a failure diagnosis (for example, a fixed opening and a fixed closing) of the sealing valve 41 and the switching valve 53. Further, the diagnostic part 67 is operative to make a diagnosis that there is no leak on the fuel tank 13 side of the evaporated fuel sealing system if the tank internal pressure varies beyond a predetermined range in a detection period by the canister internal pressure sensor 55. Note that, the detection period by the canister internal pressure sensor 55 is set considering that it is as short as possible and capable of detecting the variation of the tank internal pressure, so that an amount of the evaporated fuel sent to the canister 15 can be reduced as much as possible.

The diagnostic part 67 has further a function of diagnosing an internal pressure detection function by the canister internal pressure sensor 55. Specifically, the diagnostic part 67 diagnoses the internal pressure detection function by the canister internal pressure sensor 55 with reference to detected values of the tank internal pressure by the tank internal pressure sensor 39.

Further, the diagnostic part 67 has a function of performing the function diagnosis of the sealing valve 41 based on whether or not the canister internal pressure detected by the canister internal pressure sensor 55 varies beyond a predetermined range in a state where the sealing valve 41 is open according to an instruction of the control part 69, when the internal combustion engine is in operation and the purge by the control part 69 is not performed.

The control part 69 has a fundamental function of performing control of the purge as well as performing an instruction for opening or closing the sealing valve 41, the switching valve 53, and the purge control valve 50.

The control part 69 incorporates a SOAK timer 71 (see FIG. 2) for counting an elapsed time from a time of turning off the ignition switch 30. The control part 69 monitors whether or not the elapsed time SOAK from the time of turning off the ignition switch 30, which is a count value of the SOAK timer 71, exceeds a predetermined time SOAKth set in advance. Incidentally, the predetermined time SOAKth is preset to a time (appropriately variable time length, for example, five hours) required for a deviation of the tank internal pressure Ptank from the atmospheric pressure to become large enough, under the influence such as an evaporation of the fuel by environmental temperature and residual heat after the ignition switch 30 is turned off.

The control part 69 executes sequentially predetermined diagnostic processes which will be described later, if it is determined that the elapsed time SOAK exceeds the predetermined time SOAKth (SOAK>SOAKth).

Further, the control part 69 has a function of performing the instruction for closing the switching valve 53 as well as performing the instruction for opening the sealing valve 41, for example, during stop of the internal combustion engine.

[Operation of the Evaporated Fuel Treatment Device 11 According to the Embodiment of the Present Invention]

Figure 3A:
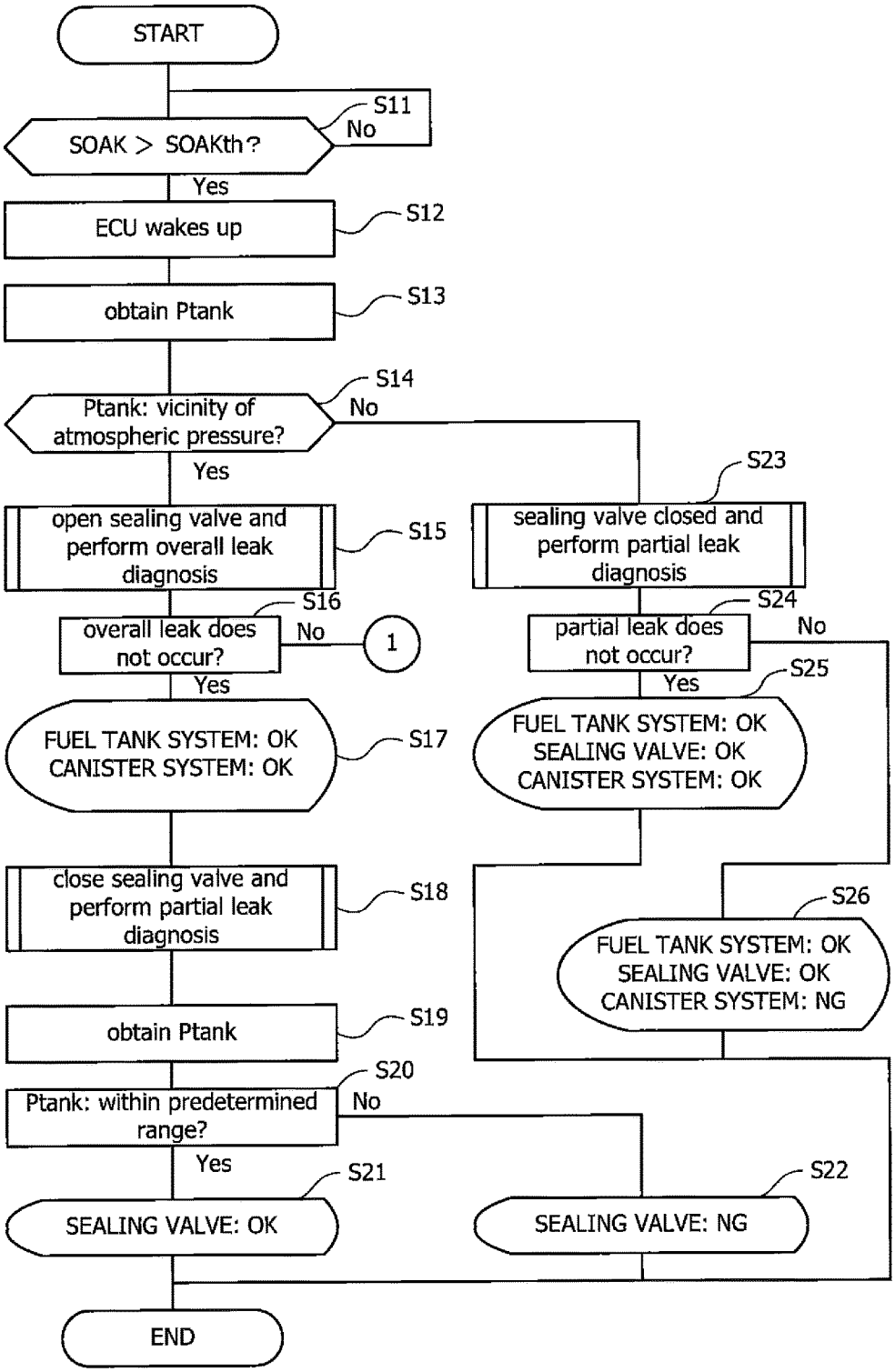
FIG. 3A is a flow chart showing a flow of a diagnostic process performed by the evaporated fuel treatment device according to the embodiment of the present invention.
Figure 3B:
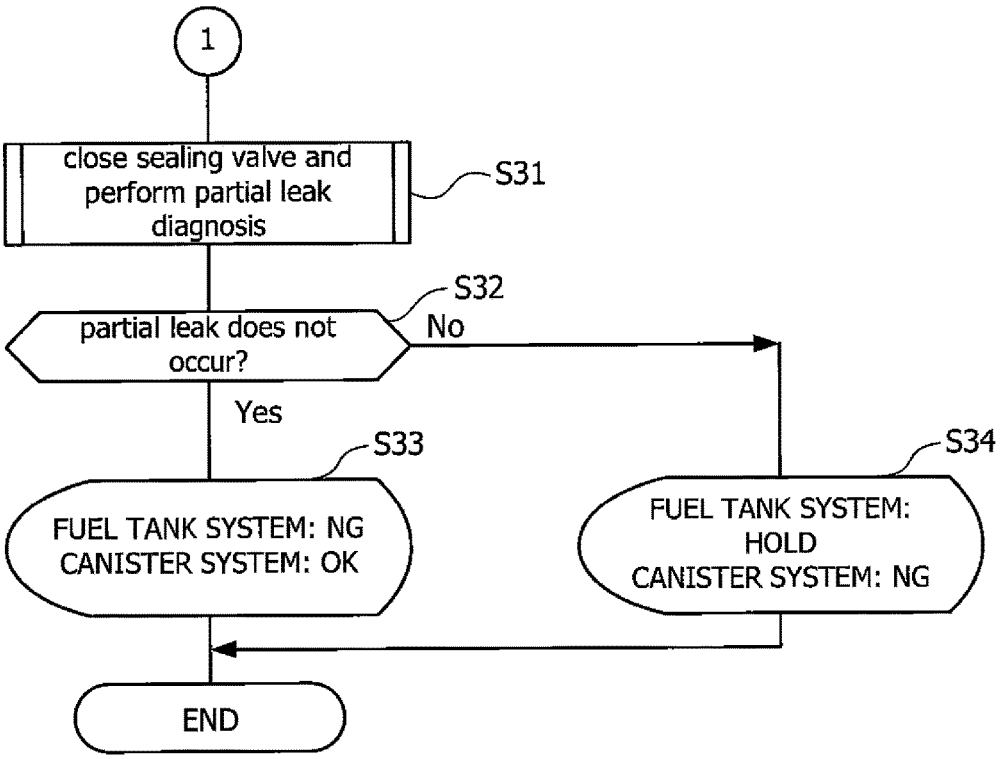
FIG. 3B is a flow chart showing a flow of a diagnostic process performed by the evaporated fuel treatment device according to the embodiment of the present invention.
Figure 3C:
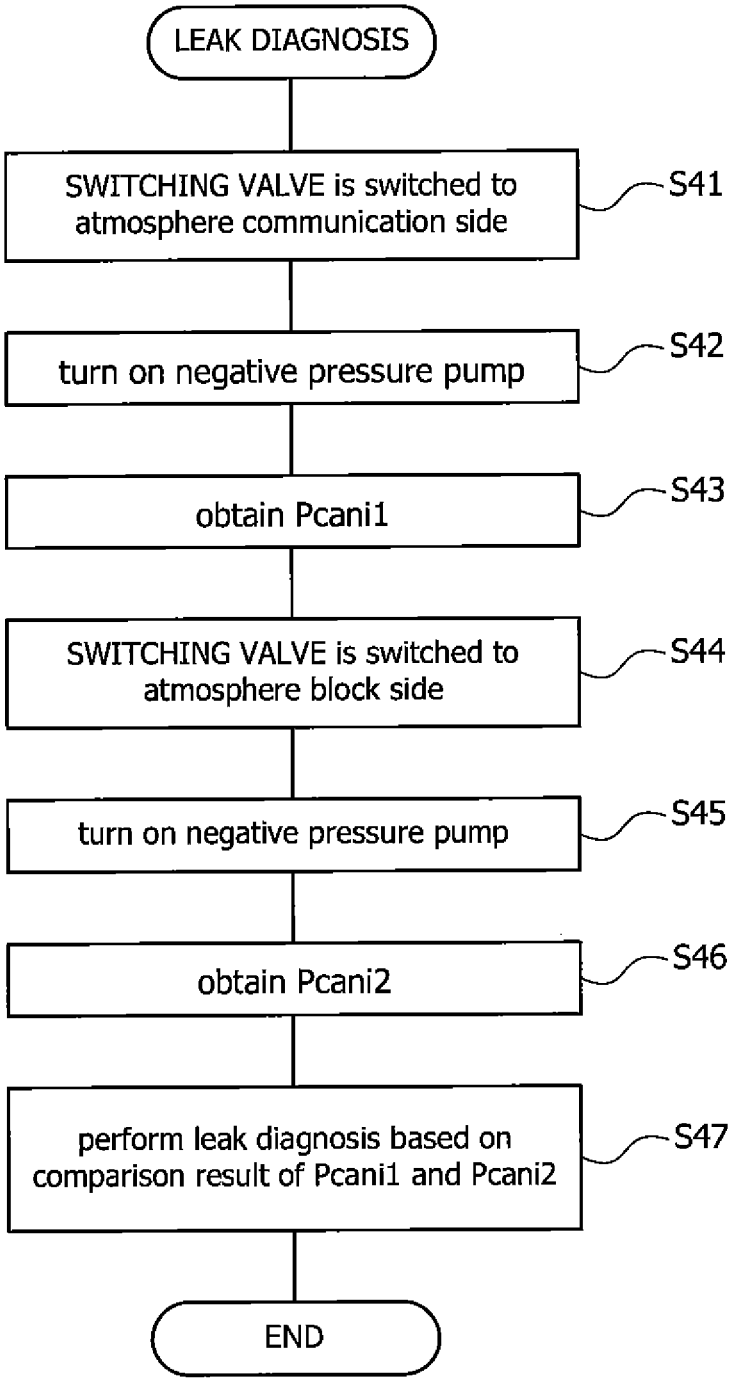
FIG. 3C is a flow chart showing a flow of a leak diagnostic process performed by the evaporated fuel treatment device according to the embodiment of the present invention.

Next, the operation of the evaporated fuel treatment device 11 according to the embodiment of the present invention will be described with reference to FIGS. 3A to 3C. FIGS. 3A and 3B are flow charts showing flows of diagnostic processes performed by the evaporated fuel treatment device 11 according to the embodiment of the present invention. FIG. 3C is a flow chart showing a flow of a leak diagnostic process performed by the evaporated fuel treatment device 11 according to the embodiment of the present invention.

Note that, FIGS. 3A and 3B shows examples of performing the diagnostic processes on the assumption that the ignition switch 30 is turned off and the ECU 17 is in a sleep mode. Here, the sleep mode means an operation mode of the ECU 17 in which energy saving is realized by limiting its function to monitoring whether or not the elapsed time SOAK, which is the count value of the SOAK timer 71, exceeds the predetermined time SOAKth.

Further, the states of the switching valve 53 and the sealing valve 41 of the evaporated fuel treatment device 11 are, as shown in FIG. 1A, assumed that the sealing valve 41 is in an open state while the switching valve 53 is in an open state which allows the canister 15 to communicate with the atmosphere.

In Step S11 shown in FIG. 3, the ECU 17 determines whether or not the elapsed time SOAK, which is the count value of the SOAK timer 71, exceeds the predetermined time SOAKth. The ECU 17 repeats the determination process of Step S11 until it determines that the elapsed time SOAK exceeds the predetermined time SOAKth. As a result of the determination in Step S11, the ECU 17 proceeds to next Step S12 of the process flow, if it makes a time-up determination that the elapsed time SOAK exceeds the predetermined time SOAKth ("Yes" in Step S11).

In Step S12, the ECU 17 wakes up by a trigger of the time-up determination that the elapsed time SOAK in Step S11 exceeds the predetermined time SOAKth, and transits from the sleep mode to an operation mode capable of performing a various functions.

In Step S13, the internal pressure obtaining part 65 obtains the tank internal pressure Ptank detected by the tank internal pressure sensor 39 at a time when the time-up determination in Step S11 is made.

In Step S14, the control part 69 determines whether or not the tank internal pressure Ptank obtained in Step S13 converges to a vicinity of the atmospheric pressure (predetermined allowable range including the atmospheric pressure). As a result of the determination in Step S14, the ECU 17 proceeds to next Step S15 of the process flow, if it is determined that the tank internal pressure Ptank converges to the vicinity of the atmospheric pressure ("Yes" in Step S14). On the other hand, as the result of the determination in Step S14, the ECU 17 proceeds to Step S23 to be described later of the process flow, if it is determined that the tank internal pressure Ptank is out of the vicinity of the atmospheric pressure ("No" in Step S14).

In general, when the elapsed time SOAK after the internal combustion engine is stopped (the ignition switch 30 is turned off) exceeds the predetermined time SOAKth, the tank internal pressure Ptank is out of the vicinity of the atmospheric pressure in many cases. In the fuel tank 13 of the vehicle during parking, the evaporated fuel is generated by the influence of the environmental temperature and the residual heat of the internal combustion engine. Further, the fuel tank 13 of the evaporated fuel treatment device 11 according to the embodiment of the present invention adopts a sealed structure which closes the sealing valve 41 during stop of the internal combustion engine.

However, if the evaporated fuel leaks in the fuel tank 13, the tank internal pressure Ptank has a tendency to converge to the vicinity of the atmospheric pressure. Therefore, it is possible to perform a tentative diagnosis of whether or not the evaporated fuel leaks in the fuel tank 13 based on whether or not the tank internal pressure Ptank converges to the vicinity of the atmospheric pressure.

Here, it is described as "tentative diagnosis", because there may be a case in which the tank internal pressure Ptank converges to the vicinity of the atmospheric pressure even if the evaporated fuel does not leak in the fuel tank 13. The leak diagnosis in such a case will be described in detail later.

As the result of the determination in Step S14, if it is determined that the tank internal pressure Ptank converges to the vicinity of the atmospheric pressure, the control part 69 performs the instruction for opening the sealing valve 41 in Step S15. Further, as shown in FIG. 1B, the diagnostic part 67 performs an overall leak diagnosis of the evaporated fuel sealing system as a whole in the state where the sealing valve 41 is open. Here, an overall leak means a state in which a leak occurs somewhere in one of the evaporated fuel sealing system.

Here, although it is in the middle of the description on the diagnostic process, the flow of the leak diagnostic process will be described with reference to FIG. 3C. Note that, as aspects of the leak diagnostic process, there are an overall leak diagnostic process and a partial leak diagnostic process. The difference between the overall leak diagnostic process and the partial leak diagnostic process is open and closed states of the sealing valve 41. That is, the sealing valve 41 is in the open state in the overall leak diagnostic process. On the other hand, the sealing valve 41 is in the closed state in the partial leak diagnostic process (the leak diagnostic process on the canister side constituting a part of the evaporated fuel sealing system).

In Step S41 shown in FIG. 3C, the control part 69 performs an instruction for switching the switching valve 53 to the atmosphere communication side which allows the canister 15 to communicate with the atmosphere. Upon receiving the instruction, the switching valve 53 is switched to the atmosphere communication side. If the switching valve 53 has been already switched to the atmosphere communication side, the process of Step S41 can be omitted.

In Step S42, the control part 69 performs an instruction for turning on the negative pressure pump 51. Upon receiving the instruction, the negative pressure pump 51 is operative to release gases existing in the internal space of the evaporated fuel sealing system into the atmosphere so that the internal pressure of the evaporated fuel sealing system becomes negative. Incidentally, the evaporated fuel is not directly released into the atmosphere, because the release of the gases existing in the internal space of the evaporated fuel sealing system is performed through the canister 15.

In Step S43, the internal pressure information obtaining part 65 obtains a first canister internal pressure Pcani1 detected by the canister internal pressure sensor 55. Here, the canister internal pressure sensor 55 is connected to the atmosphere introduction passage 47 via the reference orifice 59, as shown in FIG. 1A. Further, in Step S41, the switching valve 53 is switched to the atmosphere communication side. Therefore, the first canister internal pressure Pcani1 obtained by the internal pressure information obtaining part 65 via the canister internal pressure sensor 55 converges to a negative pressure value equal to a case in which the negative pressure pump 51 operates in a state where the evaporated fuel sealing system has a hole which is equivalent to the reference orifice 59.

The negative pressure value of the first canister internal pressure Pcani1, which is converged in this way, is stored in a memory region included in the diagnostic part 67 as a leak determination threshold value 68. The diagnostic part 67 refers to the leak determination threshold value 68 when it diagnoses whether or not the evaporated fuel sealing system has a hole larger than the reference orifice 59. Note that, a pore diameter of the reference orifice 59 is appropriately set in consideration of a diameter size of a leak hole to be a detection target.

In Step S44, the control part 69 performs an instruction for switching the switching valve 53 to the atmosphere block side where the canister 15 is blocked from the atmosphere. Upon receiving the instruction, the switching valve 53 is switched to the atmosphere block side.

In Step S45, the control part 69 performs an instruction for turning on the negative pressure pump 51. Upon receiving the instruction, the negative pressure pump 51 is operative to release the gases existing in the internal space of the evaporated fuel sealing system into the atmosphere so that the internal pressure of the evaporated fuel sealing system becomes negative.

In Step S46, the internal information obtaining part 65 obtains a second canister internal pressure Pcani2 detected by the canister internal pressure sensor 55.

In Step S47, the diagnostic part 67 performs the leak diagnosis of the evaporated fuel sealing system to be a target on the basis of a comparison result of the first canister internal pressure Pcani1 obtained in Step S43 and the second canister internal pressure Pcani2 obtained in Step S46.

Here, the second canister internal pressure Pcani2 obtained by the internal information obtaining part 65 via the canister internal pressure sensor 55 shows a tendency to become relatively rapidly negative (atmospheric pressure basis) with an internal pressure beyond the leak determination threshold value if the leak does not occur (including a case in which a diameter of a leak hole is smaller than the pore diameter of the reference orifice 59), because the switching valve 53 is switched to the atmosphere block side in Step S44.

On the other hand, the second canister internal pressure Pcani2 shows a tendency to become gradually negative (atmospheric pressure basis; including a case in which it does not become negative) with an internal pressure less than the leak determination threshold value 68 if the leak occurs (in a state where the diameter of the leak hole is larger than the pore diameter of the reference orifice 59).

In summary, the diagnostic part 67 makes a diagnosis that the leak does not occur if the second canister internal pressure Pcani2 shows the tendency to become relatively rapidly negative (atmospheric pressure basis) with the internal pressure beyond the leak determination threshold value 68 on the basis of the comparison result of the first and second canister internal pressures Pcani1, Pcani2.

On the other hand, the diagnostic part 67 makes a diagnosis that the leak in the state where the diameter of the leak hole is larger than the pore diameter of the reference orifice 59 occurs if the second canister internal pressure Pcani2 shows the tendency to become gradually negative (atmospheric pressure basis; including a case in which it does not become negative) with the internal pressure less than the leak determination threshold value 68.

Incidentally, it is possible to omit the processes of Steps S41 to S43 in the actual leak diagnostic process by performing the processes of Steps S41 to S43 to obtain the leak determination threshold value 68 in advance. In such a case, in Step S47, the diagnostic part 67 is operative to perform the leak diagnosis of the evaporated fuel sealing system to be the target on the basis of a comparison result of the second canister internal pressure Pcani2 and the leak determination threshold value 68.

Returning to the diagnostic process, in Step S16, the diagnostic part 67 determines whether or not the overall leak occurs on the basis of the diagnostic result in Step S15. As a result of the determination in Step S16, the ECU 17 proceeds to next Step S17 of the process flow, if it is determined that the overall leak does not occur ("Yes" in Step S16). On the other hand, as the result of the determination in Step S16, the ECU 17 proceeds to Step S31 to be described later of the process flow, if it is determined that the overall leak occurs ("No" in Step S16).

In Step S17, the notification part 63 notifies that the leak does not occur on the canister side and the fuel tank side among the evaporated fuel sealing system, when it receives the overall leak diagnostic result in Step S16.

Next, in Step S18, the control part 69 performs an instruction for closing the sealing valve 41. Further, as shown in FIG. 1C, the diagnostic part 67 performs the partial leak diagnosis of the evaporated fuel in the evaporated fuel sealing system in a state where the sealing valve 41 is closed. Here, the partial leak diagnosis of the evaporated fuel in the evaporated fuel sealing system means the leak diagnosis in the canister side constituting a part of the evaporated fuel sealing system. Further, the partial leak means a state in which the leak occurs on the canister side.

In Step S19, the internal information obtaining part 65 obtains the time series data of the tank internal pressure Ptank detected by the tank internal pressure sensor 39 while the partial leak diagnosis in Step S18 is performed.

In Step S20, the control part 69 determines whether or not the time series data of the tank internal pressure Ptank obtained in Step S19 converge to within a predetermined range. As a result of the determination in Step S20, the ECU 17 proceeds to next Step S21 of the process flow, if it is determined that the time series data of the tank internal pressure Ptank converge to within the predetermined range ("Yes" in Step S20). On the other hand, as the result of the determination in Step S20, the ECU 17 proceeds to Step S22 of the process flow, if it is determined that the time series data of the tank internal pressure Ptank is out of the predetermined range ("No" in Step S20).

When the partial leak diagnosis in Step S18 is performed in a state where the sealing valve 41 maintains the closed state properly, the time series data of the tank internal pressure Ptank detected by the tank internal pressure 39 during performing the partial leak diagnosis should converge to within the predetermined range without large variation. It is because the tank internal pressure sensor 39 is provided on the fuel tank 13 side relative to the sealing valve 41 in the evaporated fuel sealing system, and apart from the canister 15 side in the evaporated fuel sealing system.

As a result of the determination in Step S20, if it is determined that the time series data of the tank internal pressure Ptank converge to within the predetermined range, the notification part 63 notifies that the sealing valve 41 in the evaporated fuel sealing system operates properly (maintains the closed state) in Step S21. Then, the ECU 17 terminates a flow of a series of diagnostic processes.

On the other hand, as the result of the determination in Step S20, if it is determined that the time series data of the tank internal pressure Ptank is out of the predetermined range, the notification part 63 notifies that the sealing valve 41 in the evaporated fuel sealing system fails (cannot maintain the closed state) in Step S22. Then, the ECU 17 terminates the flow of the series of diagnostic processes.

Now, as the result of the determination in Step S14, if it is determined that the tank internal pressure Ptank is out of the vicinity of the atmospheric pressure, the control part 69 performs an instruction for keeping the sealing valve 41 closed in Step S23. Further, as shown in FIG. 1C, the diagnostic part 67 performs the partial leak diagnosis of the evaporated fuel in the evaporated fuel sealing system in the state where the sealing valve 41 is closed.

In Step S24, the diagnostic part 67 determines whether or not the partial leak occurs on the basis of the diagnostic result in Step S23. As a result of the determination in Step S24, the ECU 17 proceeds to next Step S25 of the process flow, if it is determined that the partial leak does not occur ("Yes" in Step S24). On the other hand, as the result of the determination in Step S24, the ECU 17 proceeds to Step S26 of the process flow, if it is determined that the partial leak occurs ("No" in Step S24).

In Step S25, the notification part 63 notifies that the leak does not occur on the fuel tank side, the sealing valve 41, and the canister side among the evaporated fuel sealing system, when it receives the partial leak diagnostic result in Step S23. Then, the ECU 17 terminates the flow of the series of diagnostic processes.

On the other hand, in Step S26, the notification part 63 notifies that the leak does not occur on the fuel tank side and the sealing valve 41, but occurs on the canister side among the evaporated fuel sealing system, when it receives the partial leak diagnostic result in Step S23. Then, the ECU 17 terminates the flow of the series of diagnostic processes.

As the result of the determination in Step S16, if it is determined that the overall leak occurs, the control part 69 performs the instruction for closing the sealing valve 41 in Step S31 shown in FIG. 3B. Further, as shown in FIG. 1C, the diagnostic part 67 performs the partial leak diagnosis of the evaporated fuel in the evaporated fuel sealing system in the state where the sealing valve 41 is closed.

In Step S32, the diagnostic part 67 determines whether or not the partial leak occurs on the basis of the diagnostic result in Step S31. As a result of the determination in Step S32, the ECU 17 proceeds to next Step S33 of the process flow, if it is determined that the partial leak does not occur ("Yes" in Step S32). On the other hand, as the result of the determination in Step S32, the ECU 17 proceeds to Step S34 of the process flow, if it is determined that the partial leak occurs ("No" in Step S32).

In Step S33, the notification part 63 notifies that the leak does not occur on the canister side, but occurs on the fuel tank side among the evaporated fuel sealing system, when it receives the partial leak diagnostic result in Step S31. Then, the ECU 17 terminates the flow of the series of diagnostic processes.

On the other hand, in Step S34, the notification part 63 notifies that the determination is on hold because it is unknown whether or not the leak occurs on the fuel tank side, and the leak occurs on the canister side among the evaporated fuel sealing system, when it receives the partial leak diagnostic result in Step S31. Then, the ECU 17 terminates the flow of the series of diagnostic processes.

[Time Series Operations of the Evaporated Fuel Treatment Device 11 According to the Embodiment of the Present Invention]

Figure 4A:
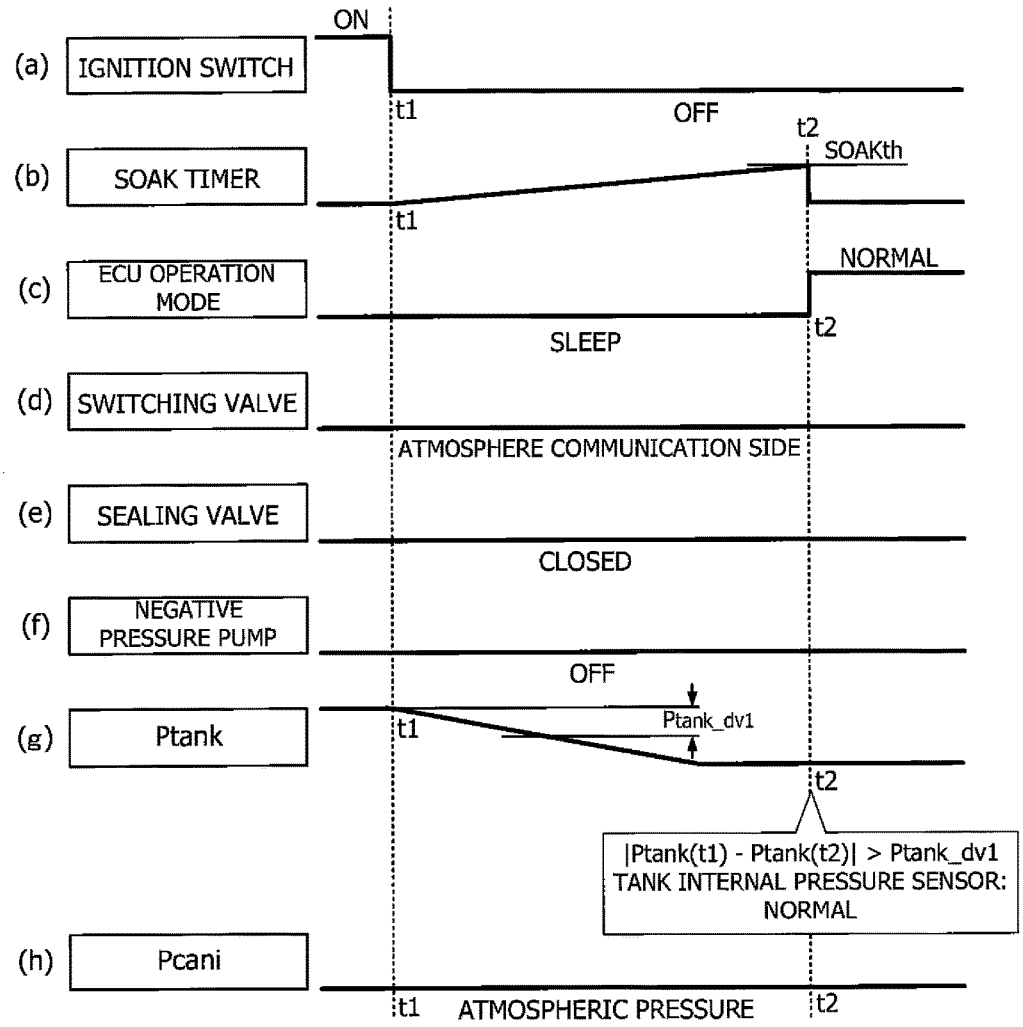
Figure 4B:
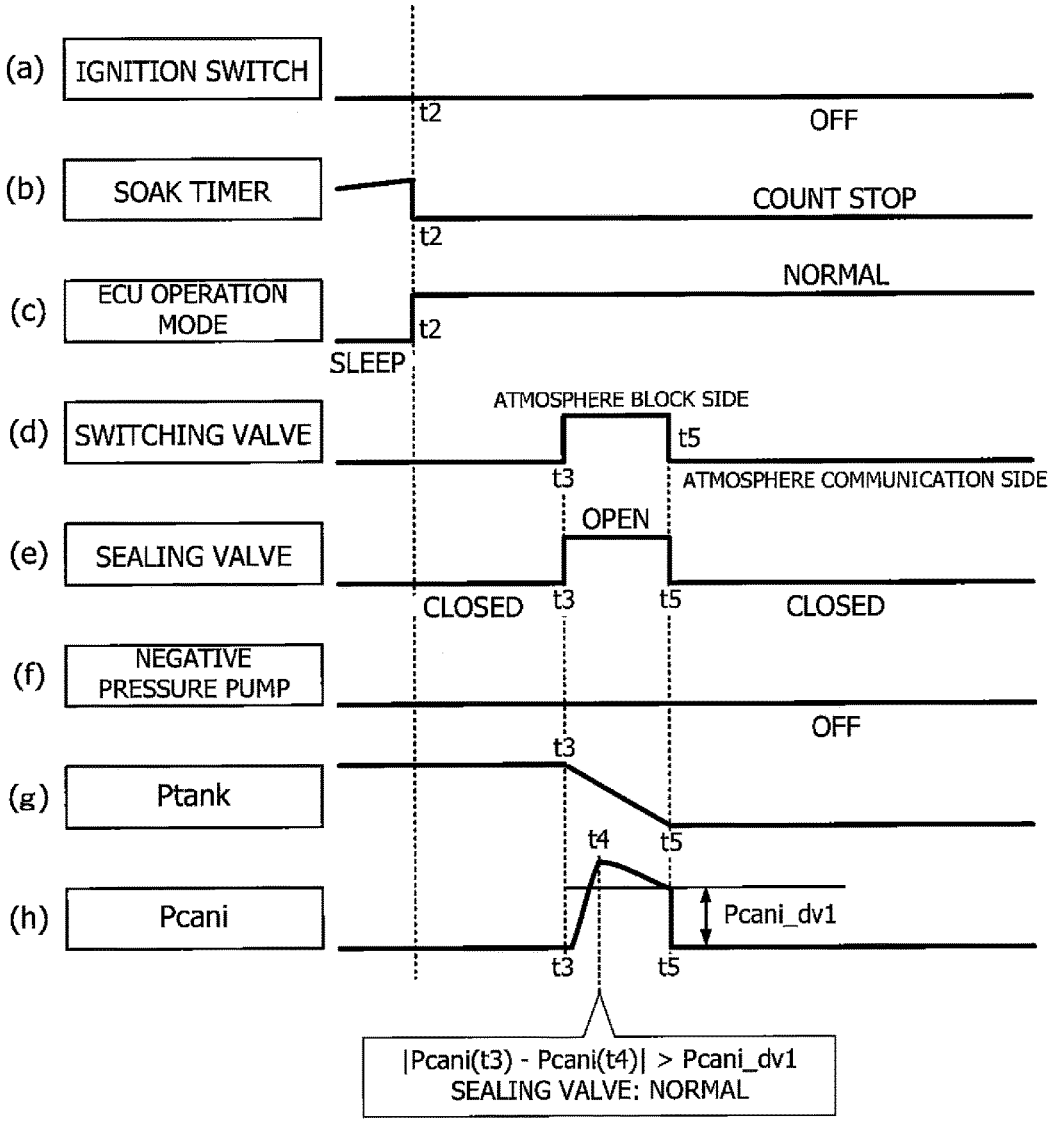
FIG. 4B is a time chart describing operations of each part belonging to the evaporated fuel treatment device after the predetermined time elapses since the ignition switch has been turned off.
Figure 4C:
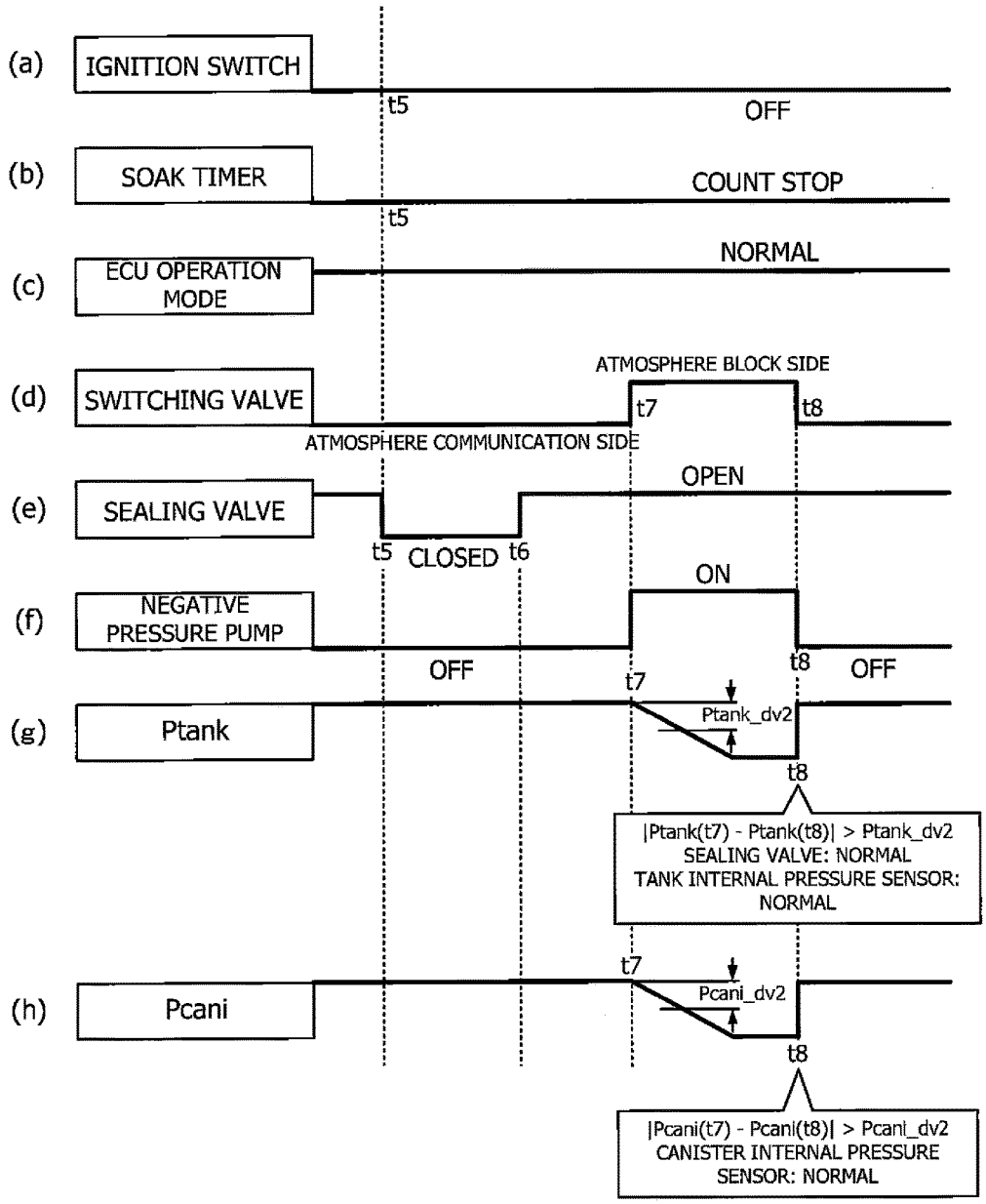
FIG. 4C is a time chart describing operations of each part belonging to the evaporated fuel treatment device after the predetermined time elapses since the ignition switch has been turned off.

Next, the time series operations of the evaporated fuel treatment device 11 according to the embodiment of the present invention will be described in detail with reference to FIGS. 4A to 4C. FIG. 4A is a time chart describing operations of each part belonging to the evaporated fuel treatment device 11 until the predetermined time SOAKth elapses after the ignition switch 30 is switched to OFF from ON. FIGS. 4B and 4C are time charts describing operations of each part belonging to the evaporated fuel treatment device 11 after the predetermined time SOAKth elapses since the ignition switch 30 has been turned off.

At time t1 shown in FIG. 4A, when the ignition switch 30 is switched to OFF from ON (see FIG. 4A (a)), the SOAK timer 71 (see FIG. 2) starts counting (see FIG. 4A (b)), and the tank internal pressure Ptank detected by the tank internal pressure sensor 39 gradually decreases (see FIG. 4A (g)). However, as a premise, the season is winter and the ambient temperature is assumed to be low (for example, about 5 degrees Celsius or less).

Note that, at the time t1 shown in FIG. 4A, operations of each part except the above part belonging to the evaporated fuel treatment device 11 are as follows. That is, the operation mode of the ECU 17 is in sleep mode (see FIG. 4A (c)). The switching valve 53 is switched to the atmosphere communication side (see FIG. 4A (d)). The sealing valve 41 is in the closed state (see FIG. 4A (e)). The negative pressure pump 51 is in OFF state (see FIG. 4A (f)). The canister internal pressure Pcani detected by the canister internal pressure sensor 55 shows the atmospheric pressure (see FIG. 4A (h)).

At time t2 shown in FIG. 4A, when the elapsed time SOAK (count value of the SOAK timer 71) from time t1 when the ignition switch 30 has been switched to OFF from ON exceeds the predetermined time SOAKth (SOAK<SOAKth: see FIG. 4A (b)), the operation mode of the ECU 17 proceeds to normal mode from sleep mode (see FIG. 4A (c)).

Further, at the time t2 shown in FIG. 4A, the diagnostic part 67 diagnoses whether or not the tank internal pressure sensor 39 operates properly based on whether or not an deviation absolute value (|Ptank(t1)−Ptank(t2)|) between the tank internal pressure Ptank(t1) obtained via the tank internal pressure sensor 39 at the time t1 and the tank internal pressure Ptank(t2) obtained via the tank internal pressure sensor 39 at the time t2 exceeds a predetermined first tank internal pressure deviation threshold value Ptank_dv1. Incidentally, the first tank internal pressure deviation threshold value Ptank_dv1 is set considering that the deviation absolute value (|Ptank(t1)−Ptank(t2)|) corresponds to a significant value excluding a detection error.

In general, when the elapsed time SOAK after the internal combustion engine is stopped (the ignition switch 30 is turned off) exceeds the predetermined time SOAKth, the tank internal pressure Ptank is out of the vicinity of the atmospheric pressure in many cases. In the fuel tank 13 of the vehicle during parking, the evaporated fuel is generated by the influence of the environmental temperature and the residual heat of the internal combustion engine. Further, the fuel tank 13 of the evaporated fuel treatment device 11 according to the embodiment of the present invention adopts the sealed structure which closes the sealing valve 41 during stop of the internal combustion engine.

However, when the tank internal pressure sensor 39 does not operate properly due to a sticking failure, the tank internal pressure Ptank, which is a detected value by the tank internal pressure sensor 39, shows a tendency of not varying between time t1 and time t2. Therefore, it is possible to perform a tentative diagnosis of whether or not the tank internal pressure sensor 39 operates properly (see FIG. 4A (g)) based on whether or not the tank internal pressure Ptank shows the tendency that it does not vary between time t1 and time t2 (whether or not the deviation absolute value (|Ptank (t1)−Ptank(t2)|) exceeds the first tank internal pressure deviation threshold value Ptank_dv1).

Here, it is described as "tentative diagnosis", because there may be a case in which the tank internal pressure sensor 39 operates properly (for example, a case in which the tank internal pressure Ptank does not actually vary between time t1 and time t2) even if the tank internal pressure Ptank detected by the tank internal pressure sensor 39 shows the tendency that it does not vary between time t1 and time t2.

The diagnostic result of whether or not the tank internal pressure sensor 39 operates properly is stored in the memory region included in the diagnostic part 67. The diagnostic result is, for example, notified to an occupant via the notification part 63 at a time when the ignition switch 30 is turned on.

Incidentally, at the time t2 shown in FIG. 4A, operations of each part belonging to the evaporated fuel treatment device 11 except the above described parts are as follows. That is, the operation mode of the ECU 17 is normal mode (see FIG. 4A (c)). The switching valve 53 is switched to the atmosphere communication side (see FIG. 4A (d)). The sealing valve is in the closed state (see FIG. 4A (e)). The negative pressure pump 51 is in OFF state (see FIG. 4A (f)). The canister internal pressure Pcani detected by the canister internal pressure sensor 55 shows the atmospheric pressure (see FIG. 4A (h)).

At the time t3 through t5 shown in FIG. 4B, the switching valve 53 is switched to the atmosphere block side from the atmosphere communication side (see the time t3 of FIG. 4B (d)), and then switched again to the atmosphere communication side (see the time t5 of FIG. 4B (d)). Meanwhile, the sealing valve 41 is switched to the open state from the closed state (see the time t3 of FIG. 4B (e)), and then switched again to the closed state (see the time t5 of FIG. 4B (e)) after a predetermined open period (time t3 through t5). Then, by a trigger of opening the sealing valve 41, the tank internal pressure Ptank detected by the tank internal pressure sensor 39 shows a tendency to decrease (see FIG. 4B (g)), while the canister internal pressure Pcani increases in a pulse shape (see FIG. 4B (h)). This is because, on the assumption that the tank internal pressure Ptank is higher than the canister internal pressure Pcani (atmospheric pressure) immediately before the time t3 shown in FIG. 4B, the internal pressure deviation between the tank internal pressure and the canister internal pressure is immediately balanced by the sealing valve 41 being opened properly in a state where the switching valve 53 is switched to the atmosphere block side (the internal space of the canister 15 side is small).

Therefore, in the open period (time t3 thorough t5) of the sealing valve 41, it is possible to perform a tentative diagnosis of whether or not the sealing valve 41 is opened properly based on whether or not a deviation absolute value (|Pcani(t3)−Pcani(t4)|) exceeds a first canister internal pressure deviation threshold value Pcani_dv1 (see FIG. 4B (h)). Here, Pcani(t3) is the canister internal pressure obtained via the canister internal pressure sensor 55 at the time t3, and Pcani(t4) is the maximum value Pcani(max) (however, it corresponds to Pcani(t4) in an example shown in FIG. 4B (h)) among a plurality of canister internal pressure values obtained via the canister internal pressure sensor 55 in the open period (time t3 through t5). Note that, the first canister internal pressure deviation threshold value Pcani_dv1 is set considering that the deviation absolute value (|Pcani(t3)−Pcani(t4)|) corresponds to a significant value excluding a detection error.

Here, it is described as "tentative diagnosis", because there may be a case in which the sealing valve 41 is opened properly (for example, a case in which the canister internal pressure Pcani (atmospheric pressure) and the tank internal pressure Ptank are approximately equal to each other at the time t3) even if the deviation absolute value (|Pcani(t3)−Pcani(t4)|) does not exceed the first canister internal pressure deviation threshold value Pcani_dv1.

The diagnostic result of whether or not the sealing valve 41 is opened properly is stored in the memory region included in the diagnostic part 67. The diagnostic result is, for example, notified to the occupant via the notification part 63 at the time when the ignition switch 30 is turned on.

Incidentally, in the time t3 through t5 shown in FIG. 4B, operations of each part belonging to the evaporated fuel treatment device 11 except the above described parts are as follows. That is, the ignition switch 30 is in OFF state (see FIG. 4B (a)). The SOAK timer 71 is stopped counting (see FIG. 4B (b)). The operation mode of the ECU 17 is normal mode (see FIG. 4B (c)). The negative pressure pump 51 is in OFF state (see FIG. 4B (f)).

At the time t6 shown in FIG. 4C, the sealing valve 41 is switched to the open state from the closed state (see FIG. 4C (e)). At the time t6, operations of each part belonging to the evaporated fuel treatment device 11 except the above described part are as follows. That is, the ignition switch 30 is in OFF state (see FIG. 4C (a)). The SOAK timer 71 is stopped counting (see FIG. 4C (b)). The operation mode of the ECU 17 is normal mode (see FIG. 4C (c)). The switching valve 53 is switched to the atmosphere communication side (see FIG. 4C (d)). The negative pressure pump 51 is in OFF state (see FIG. 4C (f)). The tank internal pressure Ptank detected by the tank internal pressure sensor 39 shows a constant value (see FIG. 4C (g)). The canister internal pressure Pcani detected by the canister internal pressure sensor 55 also shows a constant value (see FIG. 4C (h)).

In the time t7 through t8 shown in FIG. 4C, the switching valve 53 is switched to the atmosphere block side from the atmosphere communication side (see the time t7 in FIG. 4C (d)), and then switched again to the atmosphere communication side from the atmosphere block side (see the time t8 in FIG. 4C (d)). In synchronization with the operation of the switching valve 53, the negative pressure pump 51 is switched to ON state from OFF state (see the time t7 in FIG. 4C (f)), and then switched again to OFF state from ON state (see the time t8 in FIG. 4C (f)).

Further, in the time t7 through t8 (the switching period of the switching valve 53 to the atmosphere block side from the atmosphere communication side, and the switching period of the negative pressure pump 51 to ON state from OFF state) shown in FIG. 4C, the tank internal pressure Ptank detected by the tank internal pressure sensor 39 decreases (see FIG. 4C (g)), while the canister internal pressure Pcani detected by the canister internal pressure sensor 55 also decreases (see FIG. 4C (h)). This is because the gases existing in the internal space of the evaporated fuel sealing system are released into the atmosphere, so that the internal pressure of the evaporated fuel sealing system becomes negative by the negative pressure pump 51 being turned on in the state where the sealing valve 41 is open.

Therefore, when the negative pressure pump 51 is turned on in the state where the sealing valve 41 is open, the diagnostic part 67 is able to perform a diagnosis of whether or not the tank internal pressure sensor 39 and the sealing valve 41 operate properly based on whether or not an deviation absolute value (|Ptank(t7)−Ptank(t8)|) between the tank internal pressure Ptank(t7) obtained via the tank internal pressure sensor 39 at the time t7 and the tank internal pressure Ptank(t8) obtained via the tank internal pressure sensor 39 at the time t8 exceeds a predetermined second tank internal pressure deviation threshold value Ptank_dv2 (see FIG. 4C (g)). Incidentally, the predetermined second tank internal pressure deviation threshold value Ptank_dv2 is set considering that the deviation absolute value (|Ptank(t7)−Ptank(t8)|) corresponds to a significant value excluding a detection error.

The diagnostic result of whether or not the sealing valve 41 and the tank internal pressure sensor 39 operate properly is stored in the memory region included in the diagnostic part 67. The diagnostic result is, for example, notified to the occupant via the notification part 63 at the time when the ignition switch 30 is turned on.

Further, when the negative pressure pump 51 is turned on in the state where the sealing valve 41 is open, the diagnostic part 67 is able to perform a diagnosis of whether or not the canister internal pressure sensor 55 operates properly based on whether or not an deviation absolute value (|Pcani(t7)−Pcani(t8)|) between the canister internal pressure Pcani(t7) obtained via the canister internal pressure sensor 55 at the time t7 and the canister internal pressure Pcani(t8) obtained via the canister internal pressure sensor 55 at the time t8 exceeds a predetermined second canister internal pressure deviation threshold value Pcani_dv2 (see FIG. 4C (h)). Incidentally, the second canister internal pressure deviation threshold value Pcani_dv2 is set considering that the deviation absolute value (|Pcani(t7)−Pcani(t8)|) corresponds to a significant value excluding a detection error.

The diagnostic result of whether or not the canister internal pressure sensor 55 operates properly is stored in the memory region included in the diagnostic part 67. The diagnostic result is, for example, notified to the occupant via the notification part 63 at the time when the ignition switch 30 is turned on.

In the time t7 through t8 shown in FIG. 4C, operations of each part except the above parts belonging to the evaporated fuel treatment device 11 are as follows. That is, the ignition switch 30 is in OFF state (see FIG. 4C (a)). The SOAK timer 71 is stopped counting (see FIG. 4C (b)). The operation mode of the ECU 17 is in normal mode (see FIG. 4C (c)).

[Time Series Operations of the Evaporated Fuel Treatment Device 11 According to the Embodiment of the Present Invention when a Hybrid Vehicle is Running]

Figure 5A:
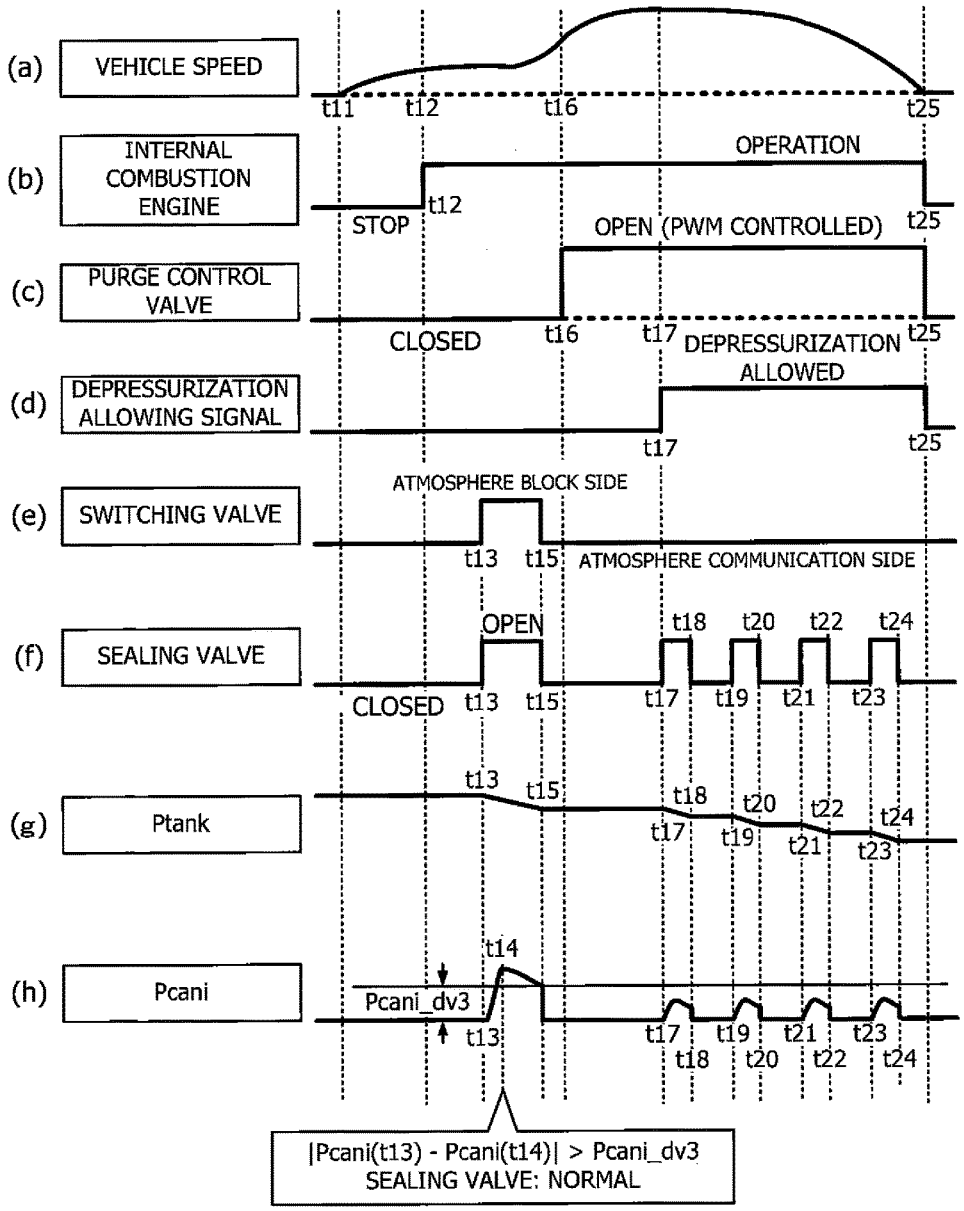
FIG. 5A is a time chart describing operations of each part belonging to the evaporated fuel treatment device when a sealing valve functions properly.
Figure 5B:
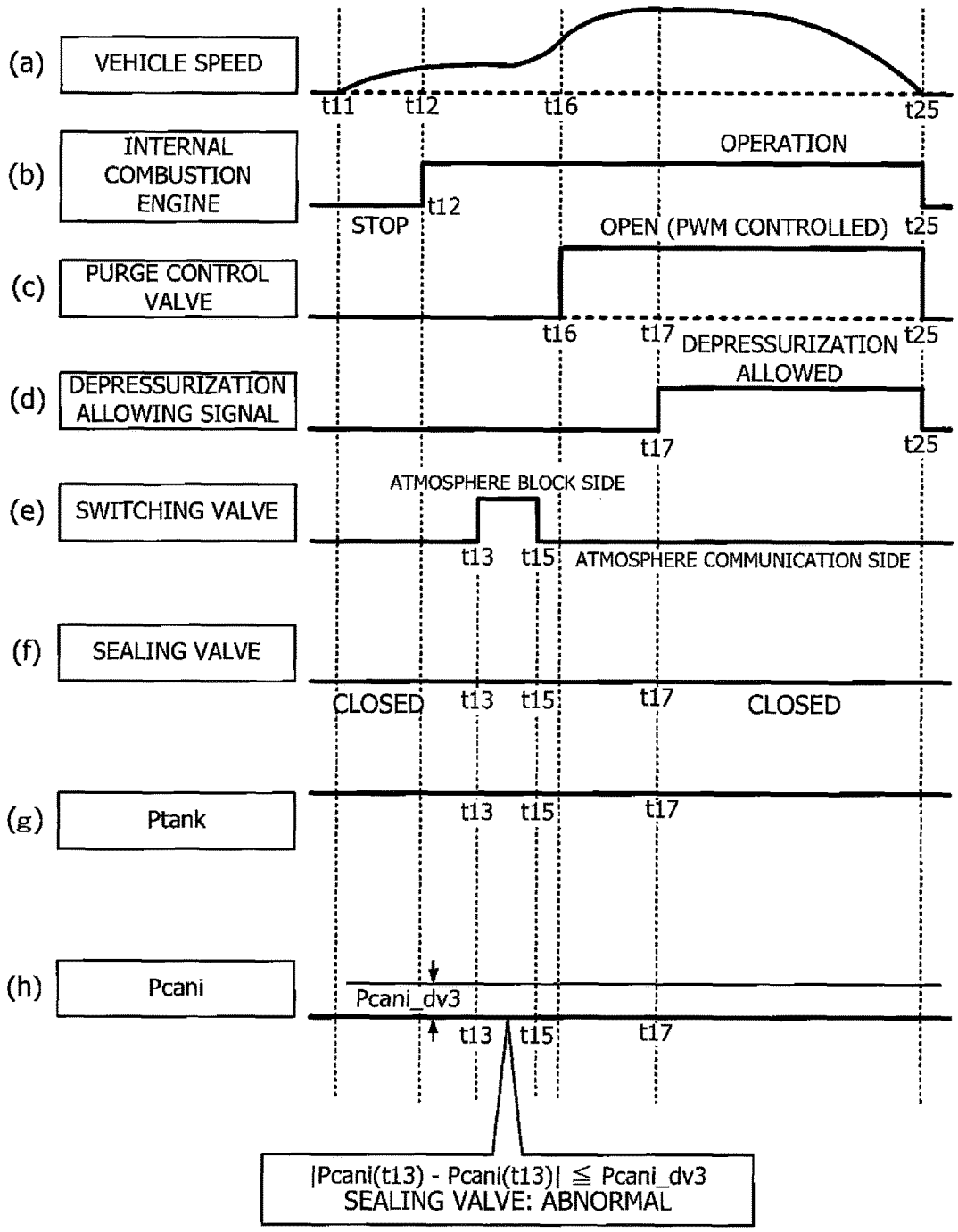
FIG. 5B is a time chart describing operations of each part belonging to the evaporated fuel treatment device when the sealing valve is in an abnormal state (closing failure).

Next, the time series operations of the evaporated fuel treatment device 11 according to the embodiment of the present invention when the hybrid vehicle is running will be described in detail with reference to FIGS. 5A and 5B. FIG. 5A is a time chart describing operations of each part belonging to the evaporated fuel treatment device 11 when the sealing valve 41 functions properly. FIG. 5B is a time chart describing operations of each part belonging to the evaporated fuel treatment device 11 when the sealing valve 41 is in an abnormal state (closing failure).

First, the operations of each part belonging to the evaporated fuel treatment device 11 when the sealing valve 41 functions properly will be described with reference to FIG. 5A. At the time t11 shown in FIG. 5A, when the hybrid vehicle starts running (see FIG. 5A (a)), to gradually increase the vehicle speed, the internal combustion engine starts operating at a predetermined timing (see the time t12 in FIG. 5A (b)).

In the time t13 through t15 shown in FIG. 5A, the switching valve 53 and the sealing valve 41 operate synchronously according to a control signal of the control part 69. Specifically, in the time t13 through t15 shown in FIG. 5A, the switching valve 53 is switched to the atmosphere block side from the atmosphere communication side (see the time t13 in FIG. 5A (e)), and then switched again to the atmosphere communication side (see the time t15 in FIG. 5A (e)). Meanwhile, the sealing valve 41 is switched to the open state from the closed state (see the time t13 in FIG. 5A (f)), and then switched again to the closed state (see the time t15 in FIG. 5A (f)) after a predetermined open period (time t13 through t15).

Then, in the open period (time t13 through t15) of the sealing valve 41, the tank internal pressure Ptank detected by the tank internal pressure sensor 39 shows a tendency to decrease (see FIG. 5A (g)), while the canister internal pressure Pcani detected by the canister internal pressure sensor 55 shows a tendency to increase (see FIG. 5A (h)).

This is because, on the assumption that the tank internal pressure Ptank is higher than the canister internal pressure Pcani (atmospheric pressure) immediately before the time t13 shown in FIG. 5A, the internal pressure deviation between the tank internal pressure and the canister internal pressure is immediately balanced by the sealing valve 41 being opened properly in the state where the switching valve 53 is switched to the atmosphere block side (the internal space of the canister 15 side is small).

Therefore, in the open period (time t13 through t15) of the sealing valve 41, it is possible to perform a tentative diagnosis of whether or not the sealing valve 41 is opened properly based on whether or not a deviation absolute value (|Pcani(t13)−Pcani(t14)|) exceeds a third canister internal pressure deviation threshold value Pcani_dv3 (see FIG. 5A (h)). Here, Pcani(t13) is the canister internal pressure obtained via the canister internal pressure sensor 55 at the time t13, and Pcani(t14) is the maximum value Pcani(max) (however, it corresponds to Pcani(t14) in an example shown in FIG. 5A (h)) among a plurality of canister internal pressure values obtained via the canister internal pressure sensor 55 in the open period (time t13 through t15). Note that, the third canister internal pressure deviation threshold value Pcani_dv3 is set considering that the deviation absolute value (|Pcani(t13)−Pcani(t14)|) corresponds to a significant value excluding a detection error.

Here, it is described as "tentative diagnosis", because there may be a case in which the sealing valve 41 is opened properly (for example, a case in which the canister internal pressure Pcani (atmospheric pressure) and the tank internal pressure Ptank are approximately equal to each other at the time t13) even if the deviation absolute value (|Pcani(t13)−Pcani(t14)|) does not exceed the third canister internal pressure deviation threshold value Pcani_dv3.

The diagnostic result of whether or not the sealing valve 41 is opened properly is stored in the memory region included in the diagnostic part 67. The diagnostic result is, for example, notified to the occupant via the notification part 63 at the time when the ignition switch 30 is turned on.

Incidentally, in the time t13 through t15 shown in FIG. 5A, operations of each part belonging to the evaporated fuel treatment device 11 except the above described parts are as follows. That is, the internal combustion engine is in operation (see FIG. 5A (b)). The purge control valve 50 is closed and the purge process is dormant (see FIG. 5A (c)). A depressurization allowing signal for allowing opening of the sealing valve 41 is not outputted (see FIG. 5A (d)).

At the time t16 shown in FIG. 5A, the purge control valve 50 is opened according to the purge control signal of the control part 69 (see FIG. 5A (c)). Note that, the control part 69 is, for example, operative to set a target purge flow rate based on a load state of the internal combustion engine, and output the purge control signal for realizing the set target purge flow rate. In practice, the purge control valve 50 is, for example, PWM controlled according to the purge control signal of the control part 69.

At the time t17 shown in FIG. 5A, a depressurization process using the sealing valve 41 is performed according to the depressurization allowing signal (see FIG. 5A (d)) of the control part 69. In the depressurization process using the sealing valve 41, the sealing valve 41 is operative to repeat closing and opening at predetermined intervals in a period where the depressurization allowing signal is outputted.

Specifically, the sealing valve 41 is switched to the open state from the closed state (see the times t17, t19, t21, t23 in FIG. 5A (f)), and then switched again to the closed state (see the times t18, t20, t22, t24 in FIG. 5A (f)) after predetermined periods (see time t17 through t18, time t19 through t20, time t21 through t22, time t23 through t24 in FIG. 5A (f)).

In each open period (see time t17 through t18, time t19 through t20, time t21 through t22, time t23 through t24 in FIG. 5A (f)) of the sealing valve 41, the tank internal pressure Ptank detected by the tank internal pressure sensor 39 shows a tendency to decrease (see FIG. 5A (g)), while the canister internal pressure Pcani detected by the canister internal pressure sensor 55 increases in a pulse shape (see FIG. 5A (h)).

However, in each open period (see time t17 through t18, time t19 through t20, time t21 through t22, time t23 through t24 in FIG. 5A (f))) of the sealing valve 41, the deviation absolute value between the canister internal pressure Pcani (atmospheric pressure) at the times t17, t19, t21, t23 and the maximum value of the canister internal pressure Pcani in the above open periods does not exceed a predetermined third canister internal pressure deviation threshold value Pcani_dv3 (see FIG. 5A (h)).

Incidentally, in the time t17 through t24 shown in FIG. 5A, operations of each part belonging to the evaporated fuel treatment device 11 except the above described parts are as follows. That is, the internal combustion engine is in operation (see FIG. 5A (b)). The purge control valve 50 is open and the purge process is in execution (see FIG. 5A (c)). The switching valve 53 is switched to the atmosphere communication side (see FIG. 5A (e)).

At the time t25 shown in FIG. 5A, when the hybrid vehicle is stopped running (see FIG. 5A (a)), the internal combustion engine is stopped (see FIG. 5A (a)) synchronously with this timing, and the purge control valve 50 is switched to the closed state from the open state (the purge process is dormant; see FIG. 5A (c)), and then the depressurization allowing signal is not outputted (see FIG. 5A (d)).

On the other hand, the operations of each part belonging to the evaporated fuel treatment device 11 when the sealing valve 41 is in fault (closing failure) will be described with reference to FIG. 5B. However, there are parts of operations common to each other between the case in which the sealing valve 41 operates properly and the case in which the sealing valve 41 is in fault (closing failure). Therefore, in order to avoid duplicated descriptions, the descriptions will be given by focusing on differences between the both cases.

When the sealing valve 41 is in fault state (failure keeping the closed state), in the entire period of t11 through t25, the sealing valve does not switched to the open state (see FIG.

5B (f)). Then, in the entire period of t11 through t25, the tank internal pressure Ptank detected by the tank internal pressure sensor 39 shows a constant value (see FIG. 5B (g)), and the canister internal pressure Pcani detected by the canister internal pressure sensor 55 also shows a constant value (see FIG. 5B (h)).

With particular attention to the time period of t13 through t15 where the instruction for opening the sealing valve 41 by the control part 69 is outputted, the deviation absolute value (|Pcani(t13)−Pcani(t13)|) between the canister internal pressure Pcani (t13) obtained via the canister internal pressure sensor 55 at the time t13 and the maximum value Pcani (max) (however, it corresponds to Pcani(t13) in an example shown in FIG. 5B (h)) among the plurality of canister internal pressure values obtained via the canister internal pressure sensor 55 in the open period (time t13 through t15) does not exceed the predetermined third canister internal pressure deviation threshold value Pcani_dv3 (see FIG. 5B (h)). In such a case, the diagnostic part 67 is operative to make a diagnosis that the sealing valve 41 is not opened properly.

[Operational Effects of the Evaporated Fuel Treatment Device 11 According to the Embodiment of the Present Invention]

Next, the operational effects of the evaporated fuel treatment device 11 according to the embodiment of the present invention will be described. The evaporated fuel treatment device 11 based on a first aspect of the present invention includes the sealing valve 41 that is provided on the evaporated fuel discharging passage (communication passage) 37 between the atmosphere and the fuel tank 13 mounted on the vehicle having the internal combustion engine, and blocks the fuel tank 13 from the atmosphere, the canister 15 that is provided between the atmosphere and the sealing valve 41 on the evaporated fuel discharging passage (communication passage) 37, and recovers evaporated fuel discharged through the evaporated fuel discharging passage (communication passage) 37 from the fuel tank 13, the canister internal pressure sensor (canister internal pressure detection unit) 55 that is provided on the canister 15 side relative to the sealing valve 41 on the evaporated fuel discharging passage (communication passage) 37, and detects a canister internal pressure in the canister 15, the control part 69 that performs the instruction for opening or closing the sealing valve 41, and controls the purge, and the diagnostic part 67 that performs the function diagnosis of the evaporated fuel sealing system including the fuel tank 13, canister 15, and the sealing valve 41.

In the evaporated fuel treatment device 11 based on the first aspect of the present invention, the diagnostic part 67 performs the function diagnosis of the sealing valve 41 based on whether or not the canister internal pressure detected by the canister internal pressure sensor (canister internal pressure detection unit) 55 varies beyond the predetermined range, in the state where the sealing valve 41 is open according to the instruction by the control part 69, when the internal combustion engine is in operation and the purge by the control part 69 is not performed.

The fuel tank 13 of the evaporated fuel treatment device 11 according to the embodiment of the present invention employs in principle a sealing structure in which the sealing valve 41 is closed. In the internal space on the fuel tank 13 side of the evaporated fuel sealing system, the evaporated fuel is generated by the influence of environmental temperature or residual heat of the internal combustion engine. Therefore, the tank internal pressure Ptank is usually maintained at a positive pressure relative to the atmospheric pressure. On the other hand, the pressure in the internal space on the canister 15 side of the evaporated fuel sealing system is the atmospheric pressure.

In these circumstances, when the sealing valve 41 kept in a closed state is opened properly, the tank internal pressure Ptank on the fuel tank 13 side of the evaporated fuel sealing system decreased, while the canister internal pressure Pcani on the canister 15 side of the evaporated fuel sealing system increases. This is because the internal pressure deviation between the both pressures is immediately balanced by opening properly the sealing valve 41 kept in the closed state.

By utilizing the above characteristics, it is possible to perform the function diagnosis of whether or not the sealing valve 41 kept in the closed state is opened properly based on whether or not the canister internal pressure Pcani varies beyond a predetermined range by a trigger of opening the sealing valve 41.

Further, the function diagnosis of whether or not the sealing valve 41 is opened properly is performed when the internal combustion engine is in operation and the purge by the control part 69 is not performed. If the function diagnosis of the sealing valve 41 is performed while the purge is performed, it becomes a state in which the evaporated fuel sealing system is communicated with the internal combustion engine side by opening the sealing valve 41. In this state, if a variation (for example, rapid acceleration) occurs in an operation state of the internal combustion engine, the variation influences the internal pressure of the evaporated fuel sealing system, and a variation trend of the tank internal pressure is deviated from an original one. Therefore, it is difficult to perform the function diagnosis of the sealing valve 41 with high accuracy.

According to the evaporated fuel treatment device 11 based on the first aspect of the present invention, the function diagnosis of the sealing valve 41 is performed based on whether or not the canister internal pressure Pcani varies beyond the predetermined range, in the state where the sealing valve 41 is open, when the internal combustion engine is in operation and the purge is not performed. Therefore, it is possible to perform the function diagnosis of the sealing valve 41 with high accuracy even if the internal combustion engine is in operation.

If the function diagnosis of the sealing valve 41 is performed while the purge is performed, the evaporated fuel flows into an intake manifold via the canister 15, the purge passage 45, and the like in accordance with opening the sealing valve 41. Then, it is not preferable from a viewpoint of performing an accurate combustion control of the internal combustion engine.

Therefore, according to the evaporated fuel treatment device 11 based on the first aspect of the present invention, it is possible to expect an effect of performing the accurate combustion control of the internal combustion engine, in addition to the above effects.

Further, the evaporated fuel treatment device 11 based on a second aspect of the present invention is the evaporated fuel treatment device 11 based on the first aspect, wherein the diagnostic part 67 makes a diagnosis that the sealing valve 41 functions properly if the canister internal pressure detected by the canister internal pressure sensor 55 varies beyond a predetermined range.

According to the evaporated fuel treatment device 11 based on the second aspect of the present invention, it is possible to perform a diagnosis that the sealing valve 41 functions properly with high accuracy, in addition to the effects of the first aspect of the present invention.

Further, the evaporated fuel treatment device 11 based on a third aspect of the present invention is the evaporated fuel treatment device 11 based on the first aspect, wherein the instruction for opening the sealing valve by the control part 69 is performed immediately after the purge beyond a predetermined amount is performed.

In the evaporated fuel treatment device 11 based on the third aspect of the present invention, when the purge beyond the predetermined amount is performed, the evaporated fuel generated until shortly before the purge in the fuel tank 13 side among the evaporated fuel sealing system, flows out to the intake manifold via the canister 15, the purge passage 45, and the like. Immediately after the evaporated fuel in the fuel tank 13 side among the evaporated fuel sealing system flows out in this way, the control part 69 is operative to perform the instruction for opening the sealing valve 41.

According to the evaporated fuel treatment device 11 based on the third aspect of the present invention, it is possible to expect an effect of performing more accurately a combustion control of the internal combustion engine, in addition to the effects of the first aspect of the present invention, because it is possible to suppress a situation in which the evaporated fuel in the fuel tank 13 side among the evaporated fuel sealing system flows out to the internal combustion engine side.

Further, the evaporated fuel treatment device 11 based on a fourth aspect of the present invention is the evaporated fuel treatment device 11 based on the first aspect, further including a tank internal pressure sensor 39 that detects the tank internal pressure in the fuel tank 13, wherein the instruction for opening the sealing valve 41 by the control part 69 is performed immediately after the purge beyond a predetermined amount is performed, if the tank internal pressure detected by the tank internal pressure sensor 39 is below a predetermined value.

A difference between the evaporated fuel treatment device 11 based on the fourth aspect of the present invention and the evaporated fuel treatment device 11 based on the third aspect is that it is added as a condition for performing the instruction for opening the sealing valve 41 by the control part 69 that the tank internal pressure detected by the tank internal pressure sensor 39 is below the predetermined value. A fact that the tank internal pressure detected by the tank internal pressure sensor 39 is below the predetermined value means that the evaporated fuel in the fuel tank 13 side among the evaporated fuel sealing system decreases to an extent below an amount corresponding to the predetermined value.

According to the evaporated fuel treatment device 11 based on the fourth aspect of the present invention, it is possible to expect an effect of performing more accurately the combustion control of the internal combustion engine, in addition to the effects of the first aspect of the present invention.

Further, the evaporated fuel treatment device 11 based on the fifth aspect of the present invention is the evaporated fuel treatment device 11 based on the first aspect, further including the tank internal pressure sensor 39 that detects the tank internal pressure in the fuel tank, wherein the instruction for opening the sealing valve 41 by the control part 69 is performed immediately after the purge beyond a predetermined amount is performed, if the tank internal pressure detected by the tank internal pressure sensor 39 is beyond a predetermined value.

A difference between the evaporated fuel treatment device 11 based on the fifth aspect of the present invention and the evaporated fuel treatment device 11 based on the third aspect is that it is added as the condition for performing the instruction for opening the sealing valve 41 by the control part 69 that the tank internal pressure detected by the tank internal pressure sensor 39 is beyond the predetermined value. A fact that the tank internal pressure detected by the tank internal pressure sensor 39 is beyond the predetermined value means that it is easy to obtain a temporal variation of the canister internal pressure associated with opening the sealing valve 41, because a pressure difference between the tank internal pressure and the canister internal pressure should be large.

According to the evaporated fuel treatment device 11 based on the fifth aspect of the present invention, it is possible to expect an effect of easily obtaining the temporal variation of the canister internal pressure associated with opening the sealing valve 41, in addition to the effects of the first aspect of the present invention.

On the other hand, the evaporated fuel treatment device 11 based on the sixth aspect of the present invention is the evaporated fuel treatment device 11 based on the first aspect, further including the switching valve 53 that is provided between the atmosphere and the canister 15 on the evaporated fuel discharging passage (communication passage) 37, and opens or blocks the canister 15 to the atmosphere. The control part 69 performs the instruction for opening the sealing valve 41 and the instruction for closing the switching valve 53 during stop of the internal combustion engine.

In the evaporated fuel treatment device 11 based on the sixth aspect of the present invention, the tank internal pressure sensor (tank internal pressure detection unit) 39 for detecting the tank internal pressure in the fuel tank 13 is provided between the sealing valve 41 and the fuel tank 13 on the evaporated fuel discharging passage (communication passage) 37. Therefore, under normal operating conditions, the tank internal pressure sensor (tank internal pressure detection unit) 39 mainly plays a role for detecting the tank internal pressure in the fuel tank 13. However, if the tank internal pressure sensor (tank internal pressure detection unit) 39 fails and outputs an abnormal value containing an error, the leak diagnosis of the evaporated fuel sealing system is performed by using the abnormal value. As a result, there is a possibility of causing a situation impairing accuracy in the leak diagnosis.

Therefore, in the evaporated fuel treatment device 11 based on the sixth aspect of the present invention, the canister internal pressure sensor (canister internal pressure detection unit) 55 is at least used for detection of a tank internal pressure in the fuel tank 13 while the sealing valve 41 is open and the switching valve 53 is closed according to the instruction by the control part 69. Here, "at least used for detection of a tank internal pressure in the fuel tank 13" means that it does not interfere with that the canister internal pressure sensor (canister internal pressure detection unit) 55 is used for another usages such as a leak detection of the fuel tank 13.

With this configuration, for example, by cross-checking a detected value of the tank internal pressure by the tank internal pressure sensor (tank internal pressure detection unit) 39 with a detected value of the tank internal pressure by the canister internal pressure sensor (canister internal pressure detection unit) 55, it is possible to verify at least one of a validity of the detected value of the tank internal pressure by the tank internal pressure sensor (tank internal pressure detection unit) 39 and a validity of the detected value of the tank internal pressure by the canister internal pressure sensor (canister internal pressure detection unit) 55.

According to the evaporated fuel treatment device 11 based on the sixth aspect of the present invention, it is possible to perform the leak diagnosis with high accuracy even if the tank internal pressure sensor (tank internal pressure detection unit) 39 outputs the abnormal value containing the error.

Note that, as a result of the cross-check, if a diagnosis is made that a value of the tank internal pressure detected by the tank internal pressure sensor 39 is abnormal, the canister internal pressure sensor 55 may be used for detecting the tank internal pressure of the fuel tank 13 as much as possible in subsequent diagnoses (until the abnormality of the tank internal pressure sensor 39 is excluded).

Further, the evaporated fuel treatment device 11 based on the seventh aspect of the present invention is the evaporated fuel treatment device 11 based on the sixth aspect, wherein the diagnostic part 67 has a function of performing a leak diagnosis of the evaporated fuel sealing system, and makes a diagnosis that there is no leak at least on the fuel tank 13 side in the evaporated fuel sealing system if the canister internal pressure sensor (canister internal pressure detection unit) 55 detects that the tank internal pressure varies beyond a predetermined range while the sealing valve 41 is open and the switching valve 53 is closed. Here, "makes a diagnosis that there is no leak at least on the fuel tank 13 side in the evaporated fuel sealing system" means that it does not interfere with that another diagnostic results such as a closing failure diagnosis of the sealing valve 41 by the diagnostic part 67 are obtained.

According to the evaporated fuel treatment device 11 based on the seventh aspect of the present invention, similarly to the sixth aspect of the present invention, it is possible to perform the leak diagnosis with high accuracy even if the tank internal pressure sensor (tank internal pressure detection unit) 39 outputs the abnormal value containing the error.

Further, the evaporated fuel treatment device 11 based on the eighth aspect of the present invention is the evaporated fuel treatment device 11 based on the seventh aspect, wherein a length of period when the sealing valve 41 is open and the switching valve 53 is closed, is set considering that a variation of the tank internal pressure is detectable.

The length of period when the sealing valve 41 is open and the switching valve 53 is closed may be appropriately set by experiments (including simulations) considering that the variation of the tank internal pressure is detectable. The length of period which is set here is preferably as short as possible. This is because it is possible to reduce as much as possible the amount of the evaporated fuel sent to the canister 15.

According to the evaporated fuel treatment device 11 based on the eighth aspect of the present invention, it is possible to appropriately set the length of period when the sealing valve 41 is open and the switching valve 53 is closed, in addition to the operational effects based on the seventh aspect of the present invention. Further, it is possible to reduce as much as possible the amount of the evaporated fuel sent to the canister 15 by setting the length of period as short as possible.

Further, the evaporated fuel treatment device 11 based on the ninth aspect of the present invention is the evaporated fuel treatment device 11 based on the seventh aspect, wherein the diagnostic part 67 has further a function of diagnosing an internal pressure detection function (including a failure detection of the canister internal pressure detection unit) by the canister internal pressure sensor (canister internal pressure detection unit) 55, and diagnoses the internal pressure detection function by the canister internal pressure sensor (canister internal pressure detection unit) 55 with reference to a detected value of the atmospheric pressure by another pressure detection unit (for example, a purge air pressure sensor or an intake manifold pressure sensor) capable of detecting the atmospheric pressure.

According to the evaporated fuel treatment device 11 based on the ninth aspect of the present invention, it is possible to recognize an abnormality of the canister internal pressure sensor (canister internal pressure detection unit) 55 accurately and quickly, because the internal pressure detection function by the canister internal pressure sensor (canister internal pressure detection unit) 55 is diagnosed with reference to the detected value of the atmospheric pressure by the another pressure detection unit, in addition to operational effects described in the seventh aspect of the present invention.

On the other hand, the evaporated fuel treatment device 11 based on the tenth aspect of the present invention is the evaporated fuel treatment device 11 according to the first aspect of the present invention, further including the tank internal pressure sensor (tank internal pressure detection unit) 39 that is provided on the fuel tank 13 side relative to the sealing valve 41 on the evaporated fuel discharging passage (communication passage) 37, and detects a tank internal pressure in the fuel tank 13.

In the evaporated fuel treatment device 11 based on the tenth aspect of the present invention, the diagnostic part 67 has a function of performing a leak diagnosis of the evaporated fuel sealing system, and when the diagnostic part 67 performs the leak diagnosis, in a state where the sealing valve 41 is closed according to the instruction by the control part 69, the diagnostic part 67 makes a diagnosis that at least the tank internal pressure sensor 39 functions properly if a deviation of a tank internal pressure detected by the tank internal pressure sensor (tank internal pressure detection unit) 39 at around the time of stopping the internal combustion engine from the tank internal pressure detected by the tank internal pressure sensor 39 at the time t2 after a predetermined time elapses from the stopping of the internal combustion engine exceeds a predetermined deviation threshold value Ptank_dv1. Here, "makes a diagnosis that at least the tank internal pressure sensor 39 functions properly" means that it does not interfere with that a diagnosis is made that the sealing valve 41 functions properly, in addition to the diagnosis that the tank internal pressure sensor 39 functions properly.

In general, when the elapsed time after the internal combustion engine is stopped exceeds the predetermined time, the tank internal pressure is out of the vicinity of the atmospheric pressure in many cases. In the fuel tank 13 of the vehicle during parking, the evaporated fuel is generated by the influence of the environmental temperature and the residual heat of the internal combustion engine. Further, the fuel tank 13 according to the present invention adopts a sealed structure which closes the sealing valve 41 during stop of the internal combustion engine.

However, for example, if the tank internal pressure sensor 39 does not operate properly due to a sticking failure, the tank internal pressure, which is a detected value by the tank internal pressure sensor 39, shows a tendency of not varying before and after the predetermined time elapses from the stopping of the internal combustion engine. Therefore, it is possible to perform a diagnosis whether or not the tank internal pressure sensor 39 operates properly based on whether or not the tank internal pressure varies before and after the predetermined time elapses from the stopping of the internal combustion engine.

Meanwhile, the diagnostic part 67 makes a diagnosis that at least the canister internal pressure sensor 55 functions properly if a variation range of the canister internal pressure detected by the canister internal pressure sensor (canister internal pressure detection unit) 55 exceeds a predetermined value when the sealing valve 41 is switched to an open state from a closed state according to the instruction by the control part 69 during stop of the internal combustion engine. Here, "makes a diagnosis that at least the canister internal pressure sensor 55 functions properly" means that it does not interfere with that a diagnosis is made that the sealing valve 41 functions properly, in addition to the diagnosis that the canister internal pressure sensor 55 functions properly.

When the sealing valve 41 is switched to the open state from the closed state, and then switched to the closed state after a predetermined open period, the tank internal pressure detected by the tank internal pressure sensor 39 decreases by the trigger of opening the sealing valve 41, while the canister internal pressure detected by the canister internal pressure sensor 55 increases. This is because, on the assumption that the tank internal pressure is higher than the canister internal pressure (atmospheric pressure), the internal pressure deviation between the both pressures is immediately balanced by the sealing valve 41 being switched to the open state from the closed state.

According to the evaporated fuel treatment device 11 based on the tenth aspect of the present invention, it is possible to perform a diagnosis of whether or not the sealing valve 41 is properly switched to the open state from the closed state based on whether or not the canister internal pressure Pcani increases beyond a predetermined threshold value Pcani_dv1 (Pcani>Pcani_dv1: see the time t4 in FIG. 4B (h)) by the trigger of opening the sealing valve 41. Therefore, according to the evaporated fuel treatment device 11 based on the tenth aspect of the present invention, it is possible to diagnose whether or not the tank internal pressure sensor 39 and the sealing valve 41 operate properly when the leak diagnosis is performed.

Further, the evaporated fuel treatment device 11 based on the eleventh aspect of the present invention is the evaporated fuel treatment device 11 according to the tenth aspect of the present invention, wherein the diagnostic part 67 has a function of performing a leak diagnosis of the evaporated fuel sealing system, and when the diagnostic part 67 performs the leak diagnosis, in a state where the sealing valve 41 is closed according to the instruction by the control part 69, the diagnostic part makes the diagnosis that the tank internal pressure sensor 39 functions properly if the deviation of the tank internal pressure detected by the tank internal pressure sensor (tank internal pressure detection unit) 39 at around the time t1 of stopping the internal combustion engine from the tank internal pressure detected by the tank internal pressure sensor 39 at the time t2 after the predetermined time elapses from the stopping of the internal combustion engine exceeds the predetermined deviation threshold value Ptank_dv1, while the diagnostic part 67 makes a diagnosis that at least the canister internal pressure sensor 55 functions properly if the variation range of the canister internal pressure detected by the canister internal pressure sensor 55 exceeds the predetermined value when the sealing valve 41 is switched to the open state from the closed state according to the instruction by the control part 69 during stop of the internal combustion engine.

According to the evaporated fuel treatment device 11 based on the eleventh aspect of the present invention, similarly to the tenth aspect of the present invention, it is possible to diagnose whether or not the tank internal pressure sensor 39 and the sealing valve 41 operate properly when the leak diagnosis is performed.

Further, the evaporated fuel treatment device 11 based on the twelfth aspect of the present invention is the evaporated fuel treatment device 11 according to the tenth aspect of the present invention, wherein the diagnostic part 67 performs at least a diagnosis of the canister internal pressure sensor 55 after a diagnosis of the tank internal pressure sensor 39.

Further, the evaporated fuel treatment device 11 based on the thirteenth aspect of the present invention is the evaporated fuel treatment device 11 according to the tenth aspect of the present invention, wherein a length of period when the sealing valve 41 is in an open state, is set considering that a variation of the canister internal pressure is detectable. The length of period which is set here is preferably as short as possible. This is because it is possible to reduce as much as possible the amount of the evaporated fuel sent to the canister 15.

According to the evaporated fuel treatment device 11 based on the thirteenth aspect of the present invention, it is possible to set appropriately the length of period when the sealing valve 41 is in the open state, in addition to operational effects of the tenth aspect of the present invention. Further, it is possible to reduce as much as possible the amount of the evaporated fuel sent to the canister 15 through the sealing valve 41 which is in the open state, by setting the length of period as short as possible.

Other Embodiments

A plurality of embodiments described above show examples of realization of the present invention. Therefore, the technical scope of the present invention should not be construed in a limited way by these embodiments. This is because the present invention can be embodied in various forms without departing from its main features or spirits.

For example, in the embodiments according to the present invention, when performing the leak diagnostic process in the evaporated fuel sealing system, an example has been described in which the internal space of the evaporated fuel sealing system is depressurized by the negative pressure pump 51, but the present invention is not limited to this. When performing the leak diagnostic process in the evaporated fuel sealing system, embodiments in which the internal space of the evaporated fuel sealing system is pressurized by the positive pressure pump, is included in the technical scope of the present invention.

Further, in the embodiments according to the present invention, it has been described with an assumption that the ambient temperature during parking is high, but the present invention is applicable to a case in which the ambient temperature during parking is low (for example, below zero degree Celsius). When the ambient temperature during parking is low, the tank internal pressure in the closed state becomes negative by liquefaction of the evaporated fuel stored in the fuel tank 13. In such a case, the present invention can be implemented by appropriately modifying the embodiments in which the tank internal pressure in the closed state is positive.

Further, in the embodiments according to the present invention, an example has been described in which the evaporated fuel treatment device 11 according to the embodiment of the present invention is applied to the hybrid vehicle including the electric motor and the internal combustion engine as drive sources, but the present invention is not limited to this. The present invention may be applied to the vehicle including only the internal combustion engine as the drive source.

REFERENCE SIGNS LIST

11: evaporated fuel treatment device
13: fuel tank
15: canister
17: ECU
37: evaporated fuel discharging passage (communication passage)
39: tank internal pressure sensor (tank internal pressure detection unit)
41: sealing valve
50: purge control valve
53: switching valve
55: canister internal pressure sensor (canister internal pressure detection unit)
67: diagnostic part
69: control part

The invention claimed is:

1. A method of operating an evaporated fuel treatment device comprising:

a sealing valve that is an electromagnetic valve controlled by an electronic control unit (ECU) and is provided on a communication passage between an atmosphere and a fuel tank mounted on a vehicle having an internal combustion engine, and blocks the fuel tank from the atmosphere;

a canister that is provided between the atmosphere and the sealing valve on the communication passage, and recovers evaporated fuel discharged through the communication passage from the fuel tank;

a canister internal pressure detection unit that is provided on a canister side relative to the sealing valve on the communication passage, and detects a canister internal pressure in the canister;

a control part that performs an instruction for opening or closing the sealing valve, and controls a purge;

a diagnostic part that performs a function diagnosis of an evaporated fuel sealing system including the fuel tank, the canister, and the sealing valve; and a switching valve that is an electromagnetic valve controlled by the electronic control unit (ECU) and is provided between the atmosphere and the canister on the communication passage, and opens or blocks the canister to the atmosphere, wherein:

the diagnostic part performs the function diagnosis of the sealing valve based on whether or not the canister internal pressure detected by the canister internal pressure detection unit varies beyond a predetermined range during a selected time period, when the sealing valve, in a closed state, is opened according to the instruction by the control part, while the internal combustion engine is in operation and the purge, controlled by the control part, is not performed, the control part performs an instruction for opening the sealing valve, and performs an instruction for closing the switching valve during stop of the internal combustion engine, and the canister internal pressure detection unit is used for detection of a tank internal pressure in the fuel tank while the sealing valve is open and the switching valve is closed according to the instruction by the control part.

2. The method of operating the evaporated fuel treatment device as set forth in claim 1, wherein the diagnostic part makes a diagnosis that the sealing valve functions properly when the canister internal pressure detected by the canister internal pressure detection unit varies beyond a predetermined range.

3. The method of operating the evaporated fuel treatment device as set forth in claim 1, wherein the instruction for opening the sealing valve by the control part is performed immediately after the purge beyond a predetermined amount is performed.

4. The method of operating the evaporated fuel treatment device as set forth in claim 1, wherein the evaporated fuel treatment device further comprises a tank internal pressure detection unit that detects the tank internal pressure in the fuel tank, and wherein the instruction for opening the sealing valve by the control part is performed immediately after the purge beyond a predetermined amount is performed, when the tank internal pressure detected by the tank internal pressure detection unit is below a predetermined value.

5. The method of operating the evaporated fuel treatment device as set forth in claim 1, wherein the evaporated fuel treatment device further comprises a tank internal pressure detection unit that detects the tank internal pressure in the fuel tank, and wherein the instruction for opening the sealing valve by the control part is performed immediately after the purge beyond a predetermined amount is performed, when the tank internal pressure detected by the tank internal pressure detection unit is beyond a predetermined value.

6. The method of operating the evaporated fuel treatment device as set forth in claim 1, wherein the diagnostic part has a function of performing a leak diagnosis of the evaporated fuel sealing system, and the diagnostic part makes a diagnosis that there is no leak at least on the fuel tank side in the evaporated fuel sealing system when the canister internal pressure detection unit detects that the tank internal pressure varies beyond a predetermined range while the sealing valve is open and the switching valve is closed.

7. The method of operating the evaporated fuel treatment device as set forth in claim 6, wherein a length of period when the sealing valve is open and the switching valve is closed, is set considering that a variation of the tank internal pressure is detectable.

8. The method of operating the evaporated fuel treatment device as set forth in claim 6, wherein the diagnostic part has further a function of diagnosing an internal pressure detection function by the canister internal pressure detection unit, and the diagnostic part diagnoses the internal pressure detection function by the canister internal pressure detection unit with reference to a detected value of the atmospheric pressure by another pressure detection unit capable of detecting the atmospheric pressure.

9. The method of operating the evaporated fuel treatment device as set forth in claim 1, wherein the evaporated fuel treatment device further comprises a tank internal pressure detection unit that is provided on the fuel tank side relative to the sealing valve on the communication passage, and is configured to detect a tank internal pressure in the fuel tank, wherein:

the diagnostic part has a function of performing a leak diagnosis of the evaporated fuel sealing system, and when the diagnostic part performs the leak diagnosis, in a state where the sealing valve is closed according to the instruction by the control part, the diagnostic part makes a diagnosis that at least the tank internal pressure detection unit functions properly when a deviation of a tank internal pressure detected by the tank internal pressure detection unit at around the time of stopping the internal combustion engine from the tank internal pressure detected by the tank internal pressure detection unit at the time after a predetermined time elapses from the stopping of the internal combustion engine exceeds a predetermined deviation threshold value, while the diagnostic part makes a diagnosis that the canister internal pressure detection unit functions properly when a variation range of the canister internal pressure detected by the canister internal pressure detection unit exceeds a predetermined value when the sealing valve is switched to an open state from a closed state according to the instruction by the control part during stop of the internal combustion engine.

10. The method of operating the evaporated fuel treatment device as set forth in claim 9, wherein when the diagnostic part performs the leak diagnosis, in a state where the sealing valve is closed according to the instruction by the control part, the diagnostic part makes the diagnosis that the tank internal pressure detection unit functions properly if the deviation of the tank internal pressure detected by the tank internal pressure detection unit at around the time of stopping the internal combustion engine from the tank internal pressure detected by the tank internal pressure detection unit at the time after the predetermined time elapses from the stopping of the internal combustion engine exceeds the predetermined deviation threshold value, while the diagnostic part makes a diagnosis that the sealing valve functions properly if the variation range of the canister internal pressure detected by the canister internal pressure detection unit exceeds the predetermined value when the sealing valve is switched to the open state from the closed state according to the instruction by the control part during stop of the internal combustion engine.

11. The method of operating the evaporated fuel treatment device as set forth in claim 9, wherein the diagnostic part performs a diagnosis of the canister internal pressure detection unit after a diagnosis of the tank internal pressure detection unit.

12. The method of operating the evaporated fuel treatment device as set forth in claim 9, wherein a length of period when the sealing valve is in an open state, is set considering that a variation of the canister internal pressure is detectable.

13. A method of operating an evaporated fuel treatment device comprising:

a sealing valve that is an electromagnetic valve controlled by an electronic control unit (ECU) and is provided on a communication passage between an atmosphere and a fuel tank mounted on a vehicle having an internal combustion engine, and blocks the fuel tank from the atmosphere;

a canister that is provided between the atmosphere and the sealing valve on the communication passage, and recovers evaporated fuel discharged through the communication passage from the fuel tank;

a canister internal pressure detection unit that is provided on a canister side relative to the sealing valve on the communication passage, and detects a canister internal pressure in the canister;

a control part that is configured to perform an instruction for opening or closing the sealing valve, and to control a purge;

a diagnostic part that diagnoses an evaporated fuel sealing system including the fuel tank, the canister, and the sealing valve; and a switching valve that is an electromagnetic valve controlled by the electronic control unit (ECU) and is provided between the atmosphere and the canister on the communication passage, and opens or blocks the canister to the atmosphere, wherein:

the diagnostic part is operable to make a diagnosis that the sealing valve functions properly when an absolute value of a maximum variation of the detected canister internal pressure is greater than a predetermined value, in which the canister internal pressure is detected while the internal combustion engine is in operation, the purge, controlled by the control part, is not performed, and the sealing valve is in an open period which is between a time when the sealing valve is switched to an opened status from a closed state and a time when the sealing valve is switched back to the closed state from the opened status, the control part performs an instruction for opening the sealing valve, and performs an instruction for closing the switching valve during stop of the internal combustion engine, and the canister internal pressure detection unit is used for detection of a tank internal pressure in the fuel tank while the sealing valve is open and the switching valve is closed according to the instruction by the control part.

14. The method of operating the evaporated fuel treatment device as set forth in claim 13, wherein the evaporated fuel treatment device further comprises a tank internal pressure detection unit that detects the tank internal pressure in the fuel tank, wherein the instruction for opening the sealing valve by the control part is performed immediately after the purge beyond a predetermined amount is performed, when the tank internal pressure detected by the tank internal pressure detection unit is below a predetermined value.

15. The method of operating the evaporated fuel treatment device as set forth in claim 13, wherein the evaporated fuel treatment device further comprises a tank internal pressure detection unit that detects the tank internal pressure in the fuel tank, wherein the instruction for opening the sealing valve by the control part is performed immediately after the purge beyond a predetermined amount is performed, when the tank internal pressure detected by the tank internal pressure detection unit is beyond a predetermined value.

16. The method of operating the evaporated fuel treatment device as set forth in claim 15, wherein the vehicle is a hybrid vehicle.

* * * * *